US010953527B2

(12) United States Patent
Wetzel et al.

(10) Patent No.: US 10,953,527 B2
(45) Date of Patent: Mar. 23, 2021

(54) CRIMPING TOOL FOR BAND CLAMP

(71) Applicant: Oetiker Tool Corporation, Branford, CT (US)

(72) Inventors: Scott Wetzel, Milford, CT (US); Joshua Schafer, Meriden, CT (US); Joseph Krzyzanski, New Haven, CT (US); Jeremy Serini, Durham, CT (US); Jeremy Roberts, Guilford, CT (US)

(73) Assignee: OETIKER TOOL CORPORATION, Branford, CT (US)

( * ) Notice: Subject to any disclaimer, the term of this patent is extended or adjusted under 35 U.S.C. 154(b) by 240 days.

(21) Appl. No.: 16/265,262

(22) Filed: Feb. 1, 2019

(65) Prior Publication Data

US 2019/0240821 A1 Aug. 8, 2019

Related U.S. Application Data

(60) Provisional application No. 62/626,391, filed on Feb. 5, 2018, provisional application No. 62/683,770, filed on Jun. 12, 2018.

(51) Int. Cl.
*B25B 7/12* (2006.01)
*B25B 27/10* (2006.01)

(52) U.S. Cl.
CPC ..... *B25B 27/10* (2013.01); *B25B 7/123* (2013.01)

(58) Field of Classification Search
CPC ..... B25B 27/10; B25B 27/146; B25B 7/12; B25B 7/123; B21D 39/046; B21D 39/048; H01R 43/042; H01R 43/0421; H01R 43/0428; B65B 13/345; B29C 65/56; B29C 66/861; B29C 66/814
USPC ..... 72/409.01, 409.19, 416, 449, 435, 72/412–414; 81/9.3, 336, 318, 319, 331
See application file for complete search history.

(56) References Cited

U.S. PATENT DOCUMENTS 3,202,022 A * 8/1965 Lothaire ..... B25B 7/10 81/357
3,657,947 A * 4/1972 Myers ..... B25B 13/28 81/134
3,732,720 A 5/1973 Cootes
4,742,737 A * 5/1988 Hatfield ..... B23D 29/023 81/355

(Continued)

FOREIGN PATENT DOCUMENTS

FR 2626517 A1 * 8/1989 ..... B25B 7/12

*Primary Examiner* — Adam J Eiseman
*Assistant Examiner* — Dylan Schommer
(74) *Attorney, Agent, or Firm* — Cantor Colburn LLP

(57) ABSTRACT

A crimping tool is provided which includes a movable jaw. The jaw being movable from an open and crimped positions. In an embodiment a linkage is coupled to the jaw and is rotatable about an axle. A member is provided having at least a first and second gear portion, the member pivoting about the linkage and moving relative to the main axle as the jaw moves from the open to the crimped position. A ring gear is coupled to the second gear portion and cooperate therewith to rotate the member about the axle. A drive gear rotates about the axle and cooperates with the first gear portion cooperating to rotate the member relative to the linkage. A handle is pivotally coupled to the axle. A drive pawl is coupled to the handle and rotates the drive gear in response to the handle moving from a first to a second position.

5 Claims, 22 Drawing Sheets

(56) References Cited

U.S. PATENT DOCUMENTS

| | | | | |
|---|---|---|---|---|
| 4,779,342 | A * | 10/1988 | Kobayashi | B23D 29/023 30/192 |
| 6,219,905 | B1 | 4/2001 | Bollesen | |
| 6,832,532 | B2 | 12/2004 | Kilpela et al. | |
| 8,312,755 | B1 | 11/2012 | Steiner et al. | |
| 9,339,939 | B1 * | 5/2016 | Haney | B25B 7/08 |
| 2006/0230810 | A1 * | 10/2006 | Gallentine | B25B 7/123 72/453.16 |
| 2007/0289353 | A1 | 12/2007 | Fiorisi | |
| 2008/0163664 | A1 | 7/2008 | Battenfeld | |

* cited by examiner

CRIMPING TOOL FOR BAND CLAMP

CROSS-REFERENCE TO RELATED APPLICATIONS

The present application claims the benefit of U.S. Provisional Application Ser. No. 62/626,391 filed on Feb. 5, 2018 and U.S. Provisional Application Ser. No. 62/683,770 filed on Jun. 12, 2018, the contents of both of which are incorporated by reference herein in their entirety.

BACKGROUND

The subject matter disclosed herein relates to a hand tool, and in particular to a hand tool for crimping clamps for coupling crossed-linked polyethylene (PEX) tubing.

PEX tubing is used in a variety of applications to transfer fluid between locations. PEX tubing provides many advantages as its inherent flexibility allows for installations that would be difficult or impossible with traditional tubing materials, such as copper. Where an installation uses a joint, such as a t-joint for example, or multiple tube are connected together, a fitting is used. Typically, the PEX tube is installed over the outer diameter of the fitting and a clamp is installed over the tube. The clamp secures the tube on the fitting.

One type of clamp is a stainless steel band clamp that formed in a shape of a ring. The ring is slid over and surrounds the tubing and fitting. A tool is then used to crimp the clamp onto the tube. The process of crimping the band reduces the diameter of the band to secure the tubing and also deforms the band material to reduce the risk of the clamp loosening over time. It should be appreciated that considerable force is used to crimp the band. Typical tools perform the crimp with a single actuation of the tool. In many instances this causes tool to have longer than desired handles in order to obtain a desired mechanical advantage.

Accordingly, while existing crimping tools are suitable for their intended purposes the need for improvement remains, particularly in providing a crimping tool that includes the features and advantages described herein.

BRIEF DESCRIPTION

According to one aspect of the disclosure a crimping tool is provided. The crimping tool includes a stationary jaw and a movable jaw adjacent the stationary jaw. The movable jaw being movable from an open position to a crimped position. A linkage is coupled to the movable jaw on one end, the linkage rotatable about a main axle. A transfer member is provided having a second gear portion and a first gear portion, the transfer member being pivotally coupled to the linkage, the transfer member rotating relative to the linkage and relative to the main axle as the movable jaw moves from the open position to the crimped position. A ring gear is operably coupled to the second gear portion, the ring gear cooperating with the second gear portion to rotate the transfer member about the main axle. A drive gear is rotatably coupled to the main axle and operably coupled to the first gear portion, the drive gear and first gear portion cooperating to rotate the transfer member relative to the linkage. A movable handle is pivotally coupled to the main axle. A drive pawl is pivotally coupled to the movable handle and operably coupled to the drive gear, the handle and drive pawl cooperating to rotate the drive gear in response to the movable handle moving from a first position to a second position.

In accordance with another embodiment, a crimping tool is provided. The crimping tool includes a stationary jaw and a movable jaw adjacent the stationary jaw. The movable jaw being rotatable about an axle from an open position to a crimped position. A transfer member having a first gear portion, a second gear portion and a third gear portion is provided. The transfer member is pivotally coupled to the movable jaw, the transfer member further rotates relative to the linkage and relative to the axle as the movable jaw moves from the open position to the crimped position. A ring gear is operably coupled to the third gear portion, the ring gear cooperating with the third gear portion to rotate the transfer member about the axle. A drive gear is rotatably coupled to the axle and operably coupled to the first gear portion and the second gear portion, the drive gear and first gear portion, the second gear portion and the third gear portion cooperating to rotate the transfer member relative to the movable jaw and the axle. A movable handle is pivotally coupled to the axle. A drive pawl is pivotally coupled to the movable handle and operably coupled to the drive gear, the handle and drive pawl cooperating to rotate the drive gear in response to the movable handle moving from a first position to a second position.

These and other advantages and features will become more apparent from the following description taken in conjunction with the drawings.

BRIEF DESCRIPTION OF DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

The detailed description explains embodiments of the disclosure, together with advantages and features, by way of example with reference to the drawings.

DETAILED DESCRIPTION

Embodiments disclosed herein provide for a crimping tool for band clamps, such as those used with PEX tubing. Embodiments of the crimping tool provide advantages in increasing the mechanical advantage to reduce the force used by the operator during a crimping operation. Further embodiments of the crimping tool provide advantages in allowing the operator to actuate the handle of the crimping tool multiple times in a single crimping operation with removing the tool from the band clamp or reposition of the operator's hand.

Figure 1A:
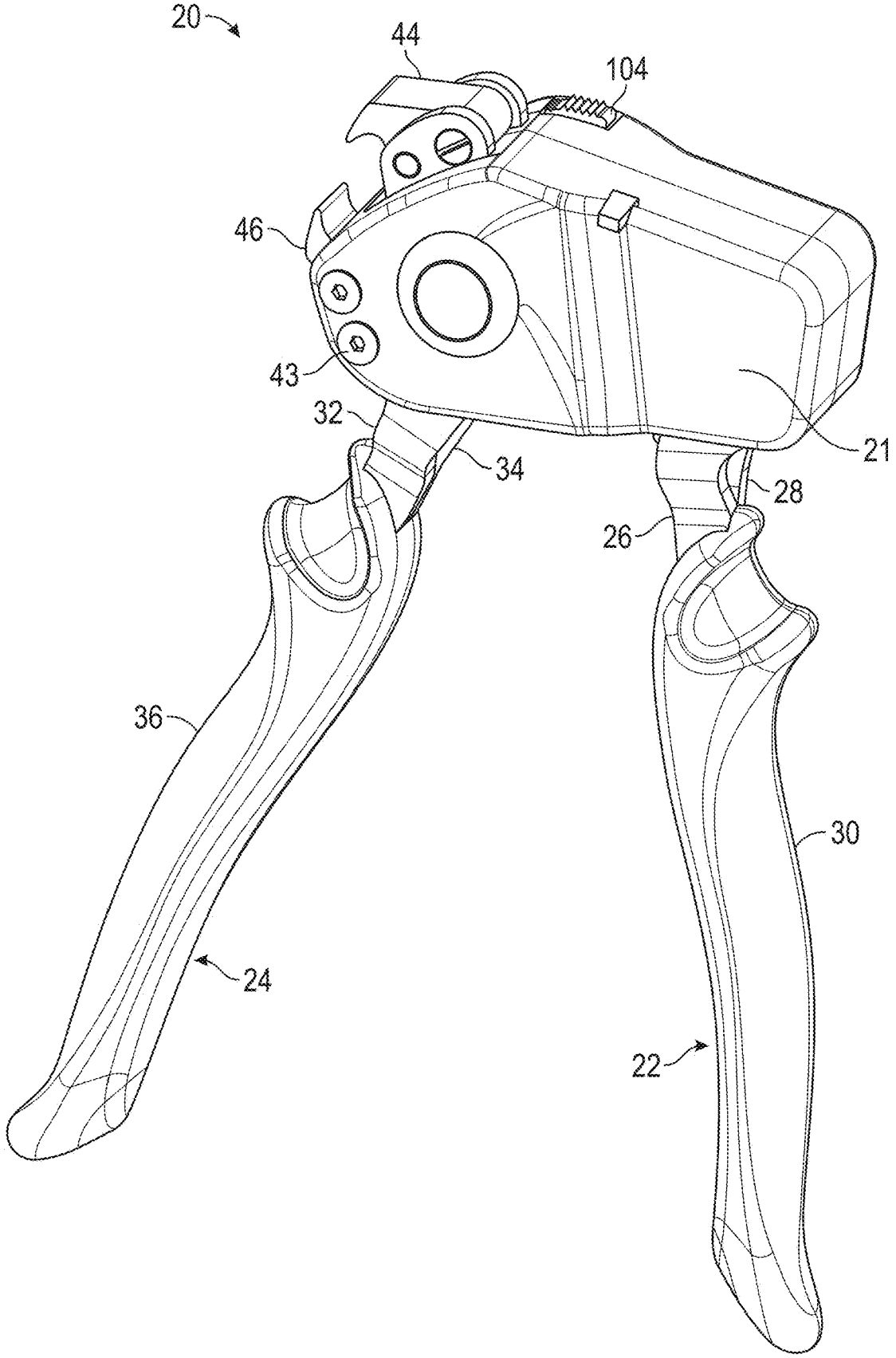
FIG. 1A is a perspective view of a crimping tool in an open position in accordance with an embodiment.
Figure 1B:
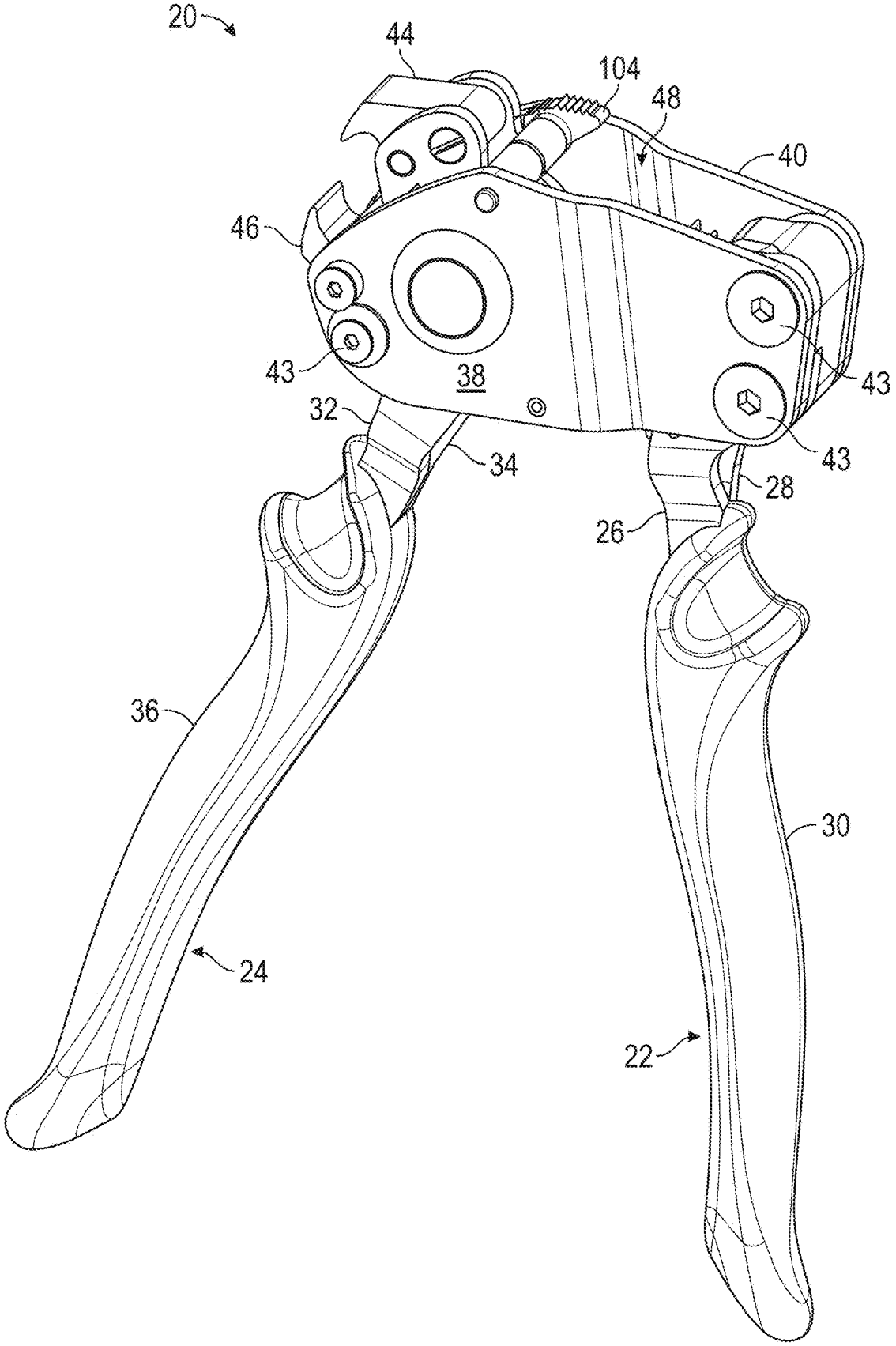
FIG. 1B is a perspective view of the crimping tool of FIG. 1A with a cover removed.

Referring now to FIG. 1A and FIG. 1B, a crimping tool 20 is shown having a stationary handle 22 and a movable handle 24. The stationary handle is formed from a pair of arms 26, 28 that are covered by a grip member 30. The movable handle is similarly formed having a pair of arms 32, 34 that covered by a second grip member 36. As will be discussed in more detail herein, each of the arms 26, 28, 32, 34 bend away from the adjoining arm to define a gap for the arrangement of the crimping mechanism.

The stationary arm 22 is fixedly attached to a pair of side plates 38, 40 that define an outer body of the crimping portion of the tool 20. The side plates 38, 40 are coupled to each other by one or more fasteners 43. In one embodiment, a cover member 21 is disposed over the side plates 38, 40. The movable handle 24 is rotatably coupled to the side plates 38, 40. As will be described in more detail herein, the movable handle 24 rotates about a main axle 42 to actuate movable jaw 44 from an open position to a closed position adjacent a stationary jaw 46 via a crimping mechanism 48. When a band clamp 50 (FIG. 12) is inserted between the jaws 44, 46 and the movable handle 24 is moved between a first position and a second position, the crimping mechanism 48 causes the jaws 44, 46 to close and crimp the band clamp.

Figure 2:
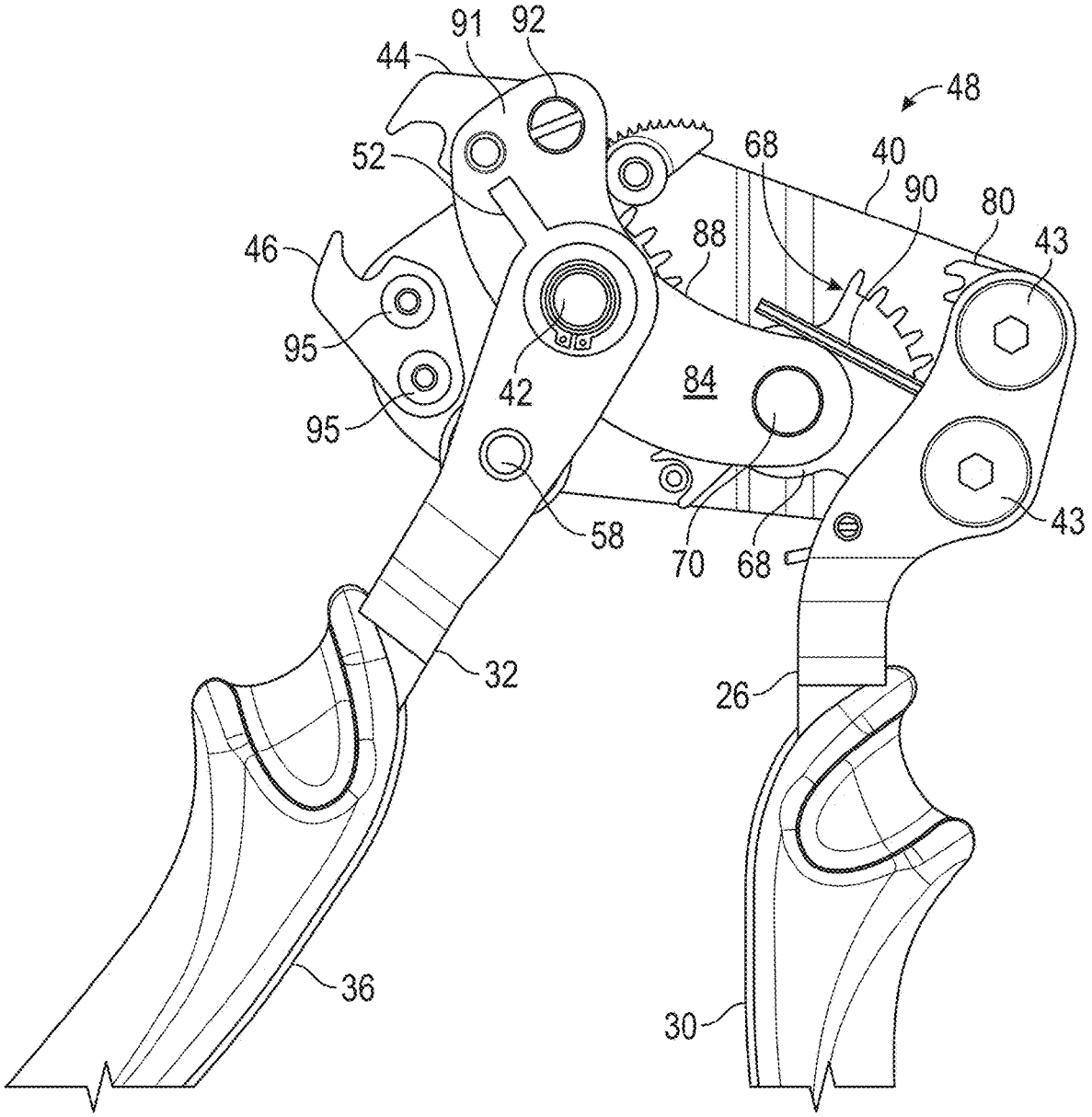
FIG. 2 is a partial side view of the crimping tool of FIG. 1A.
Figure 3:
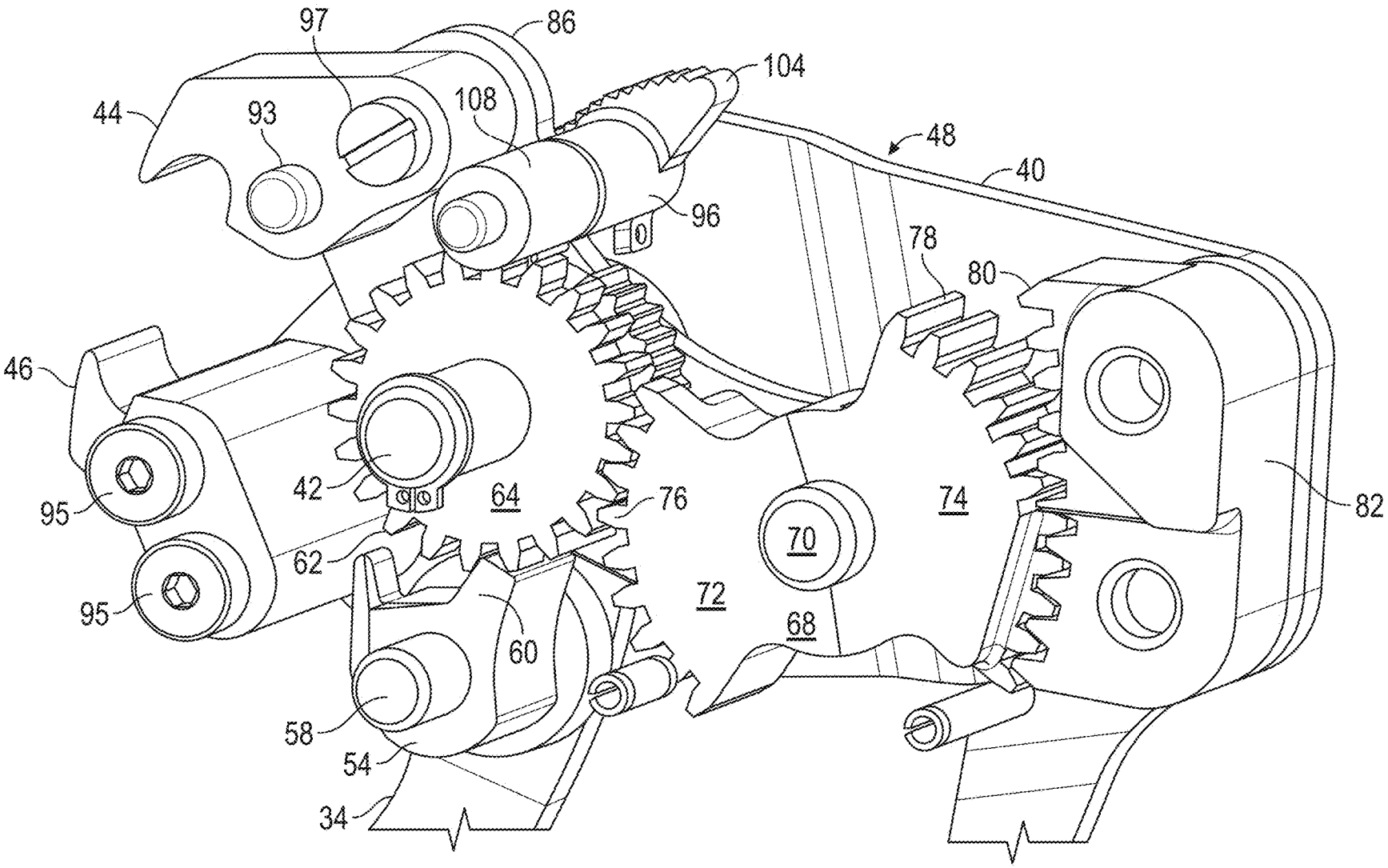
FIG. 3 is a partial enlarged perspective view of the crimping tool of FIG. 1A with a side plate and link removed.
Figure 4:
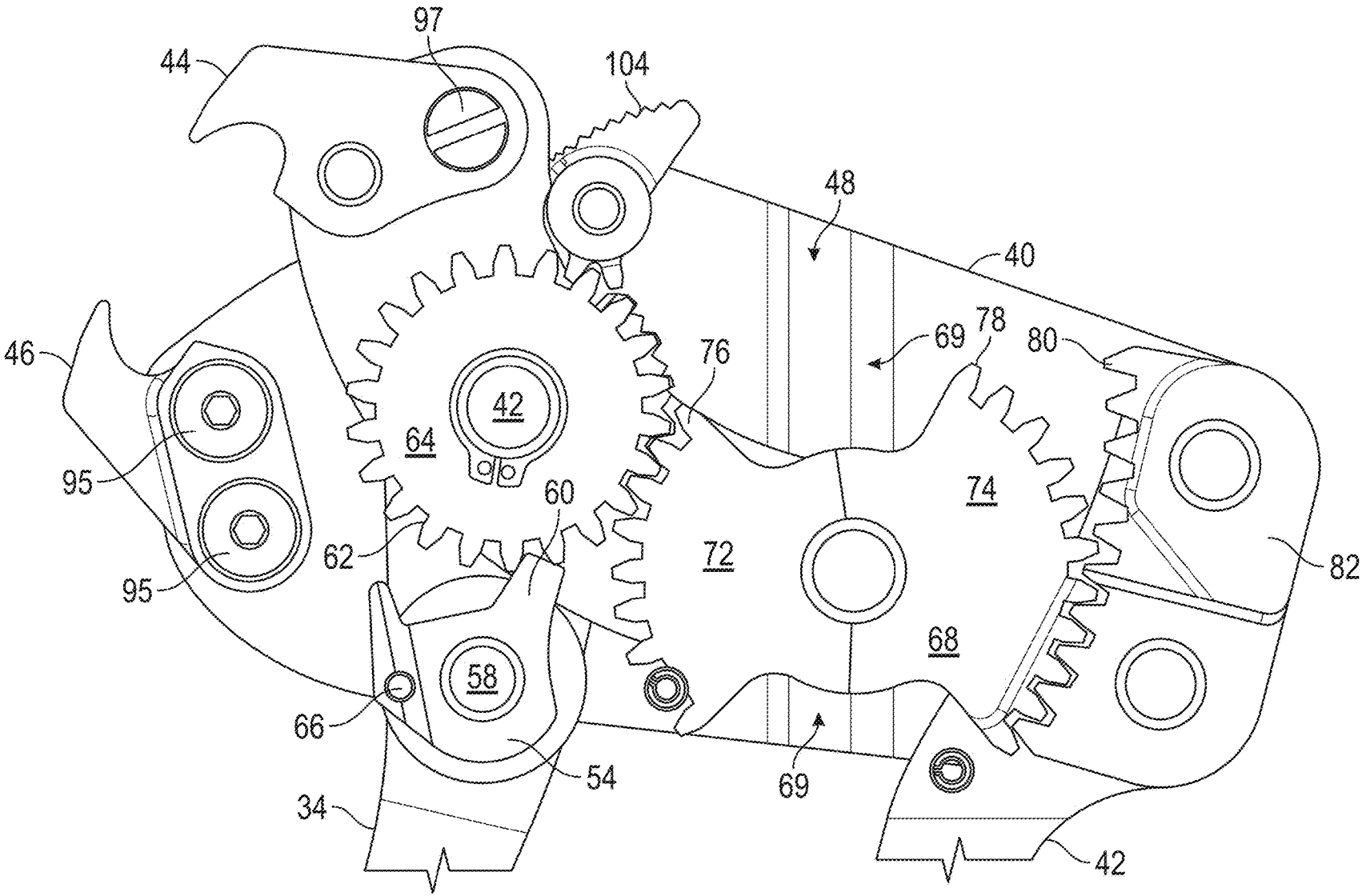
FIG. 4 is a partial size view of the operating mechanism of the crimping tool of FIG. 1A.

Referring now to FIGS. 2-4, a crimping portion of the crimping mechanism 48. The movable handle 24 rotates about a main axle 42. In an embodiment, the movable handle includes a projection 52 that couples with a biasing member (not shown), such as an extension spring for example, that biases the movable handle 24 towards the open position (FIG. 1A). A drive pawl 54 is disposed in a gap 56 between the arms 32, 34 by a pin 58. The drive pawl 54 includes a lever portion 60 that is arranged to engage the teeth 62 of a drive gear 64. In the exemplary embodiment, the drive pawl 54 rotates on the pin 58, and includes a feature, such as opening 66 for example, that receives a biasing member (not shown) such as an extension spring for example. The biasing member is arranged to rotate the drive pawl 54 counter-clockwise (when viewed from the position of FIG. 4) into engagement with the teeth 62. In an embodiment, the teeth 62 have an involute profile.

It should be appreciated that when the movable handle 24 is moved from the first position (FIG. 1A) towards the stationary handle 22 to a second position (FIG. 8 and FIG. 9), the end of the lever 60 engages the teeth 62 and causes the drive gear 64 to rotate counter-clockwise about the main axle 42. In an embodiment, the lever 60 is sized to move between a pair of adjoining teeth 62 with the end of the lever 60 contacting a first tooth and a back side of the lever 60 contacting the adjoining tooth. This arrangement locks the lever 60 against the teeth 62 while the movable handle 24 is moved. When the moveable handle 24 is released, the movable handle 24 is biased away from the stationary handle 22. As the movable handle 24 moves from the second position (FIG. 8 and FIG. 9) to the first position (FIG. 1A), the drive pawl 54 rotates about pin 58 in a clockwise rotation to release the lever 60 from the teeth 62. It should be appreciated that one the movable handle 24 stops moving, the biasing force of the spring attached to the drive pawl 54 cause the lever 60 to reengage the teeth 62.

Coupled to the drive gear 64 is a transfer member 68. In an embodiment, the transfer member is a planet gear with two sections 69 removed. The transfer member 68 is pivotally mounted on a pin 70 and includes a first gear portion 72 and a second gear portion 74. The first gear portion 72 includes a plurality of gear teeth 76 that are sized and positioned to engage the teeth 62 of the drive gear 76. In an embodiment, the plurality of gear teeth 76 have an involute profile shaped to engage the teeth 62 of the drive gear 64. In an embodiment, the plurality of gear teeth 76 extend over an arc length of less than 180 degrees. The second gear portion 74 includes a plurality of gear teeth 78. In an embodiment the gear teeth 78 extend over an arc length of less than 180 degrees and have an involute profile. The gear teeth 78 are arranged to engage gear teeth 80 of ring gear 82. The ring gear 82 is stationary relative to the side plates 38, 40. In an embodiment, the ring gear 82 is coupled to the side plates 38, 40 by the fasteners 42.

As the drive gear 64 is rotated counter-clockwise (when viewed from the viewpoint of FIG. 4), by the movement of the movable handle 24 and the drive pawl 54, the transfer member 68 is moved in two directions simultaneously due to the interaction of the teeth 62, 76 and the teeth 78, 80. The first motion caused by the engagement of the teeth 62, 76 causes the transfer member 68 to rotate clockwise (from the viewpoint of FIG. 4) about the pin 70. The second motion caused by the engagement of the teeth 78, 80 causes the pin 70 and transfer member 68 to rotate counter-clockwise (from the viewpoint of FIG. 4) about the main axle 42.

A pair of linkages 84, 86 are disposed on either side of the transfer member 68. The linkages 84, 86 are rotatably coupled to pivot about the main axle 42. The linkages 84, 86 are further pivotally coupled to the pin 70 on one end. In an embodiment, each of the linkages 84, 86 includes an arcuate side 88 that engages a roller that limits the range of motion of the crimping mechanism 48 as will be described in more detail herein. It should be appreciated that as the transfer member 68 rotates about the main axle 42 and pivots on pin 70, the linkages 84, 86 will also pivot about the main axle 42 due to the connection of pin 70.

Figure 8:
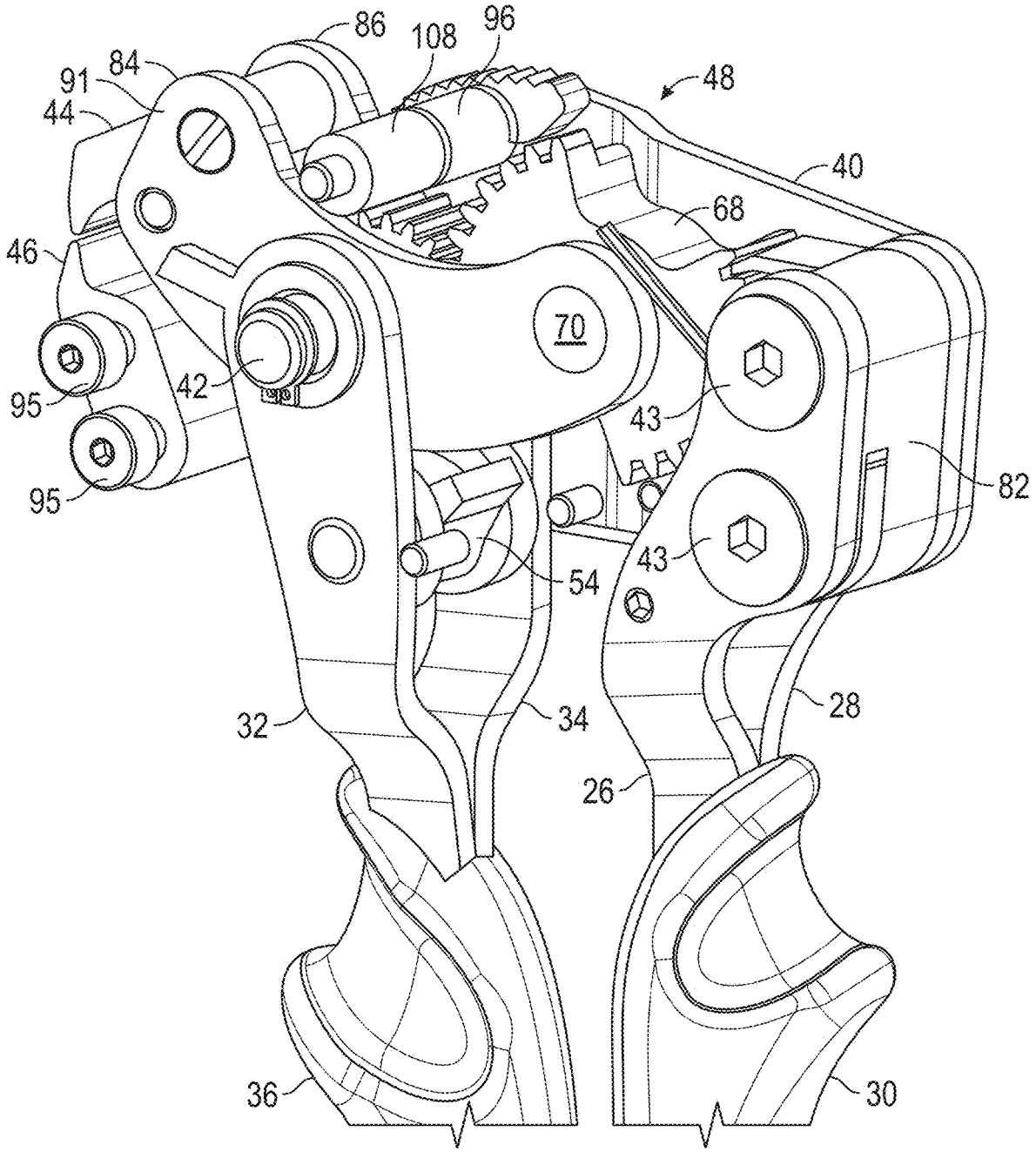
FIG. 8 is a partial perspective view of the crimping tool of FIG. 1A with a side plate removed and in a closed position.
Figure 9:
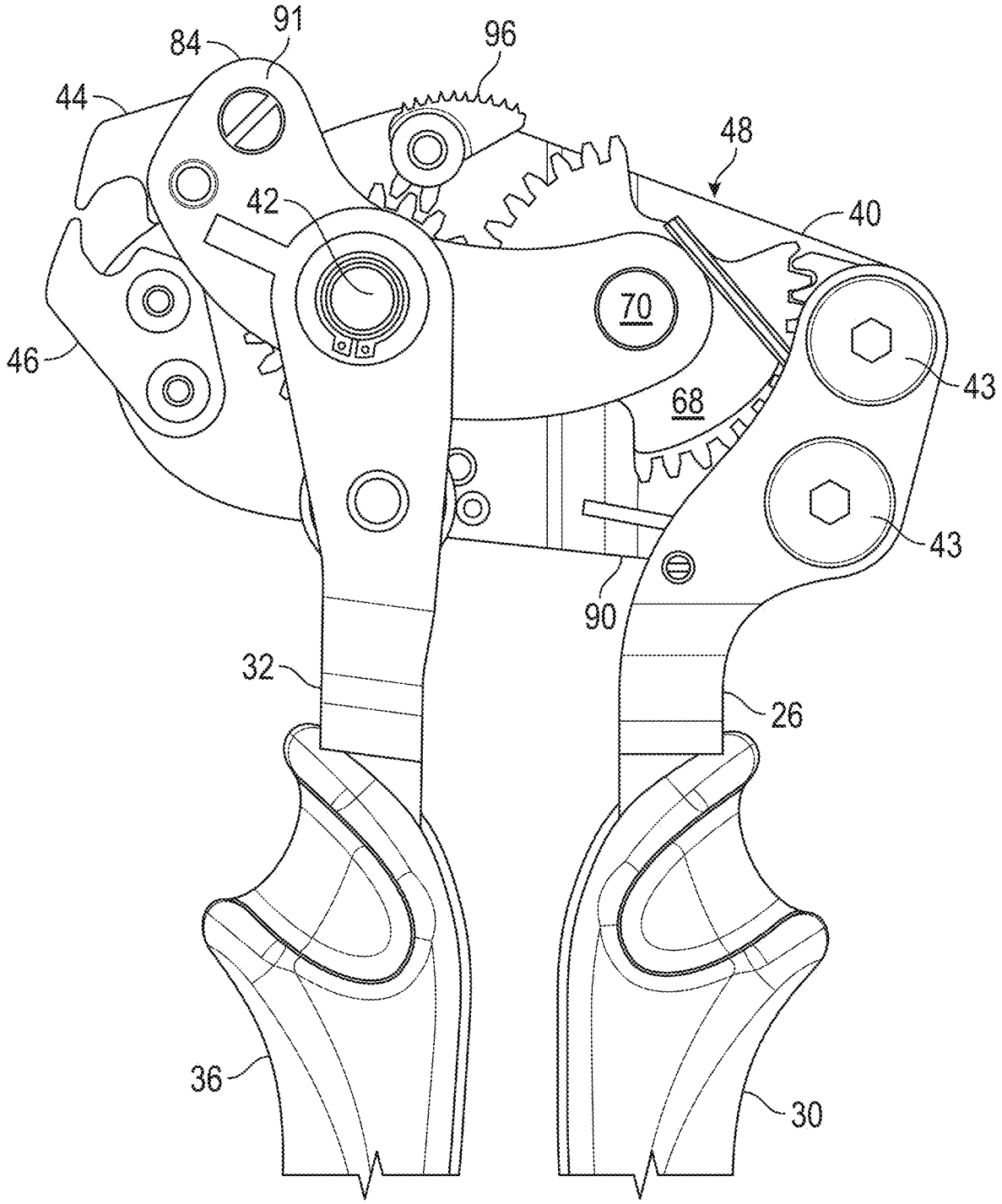
FIG. 9 is a side view of the crimping tool of FIG. 8 with a side plate removed.

The movable jaw 44 is coupled between ends 91 of the linkages 84, 86. In the exemplary embodiment, the movable jaw 44 is coupled by a pair of fasteners 93, 97. In an embodiment, the fastener 97 is a fastener with an eccentric shaft, such that when the fastener is rotated, the position of the movable jaw 44 may be moved. This movement may be performed to calibrate the tool 20 for example. In the exemplary embodiment, the stationary jaw 46 is coupled in a fixed position to the side plates 38, 40 by a pair of fasteners 95. It should be appreciated that since the movable jaw 44 is coupled to the linkages 84, 86, as the linkages 84, 86 are pivoted about the main axle by the movement of the transfer member 68, the movable jaw 44 will also rotate about the main axle 42 to move the movable jaw 44 towards the stationary jaw 46 (FIGS. 8-9). In an embodiment, a biasing member such as torsion spring 90 for example, applies a force on at least one of the linkages 84, 86 to rotate the linkages 84, 86, transfer member 68, drive gear 64 and handle 24 towards the open or first position (FIG. 1A).

It should be appreciated that the gear ratio between the drive gear 64 and the ring gear 82, the lever arms of the linkages 84, 86 cooperate to generate a mechanical advantage to assist in the crimping of a band clamp as is described herein. In the exemplary embodiment, the gear ratio between the drive gear 64 and ring gear 82 is 4:1.

Figure 5:
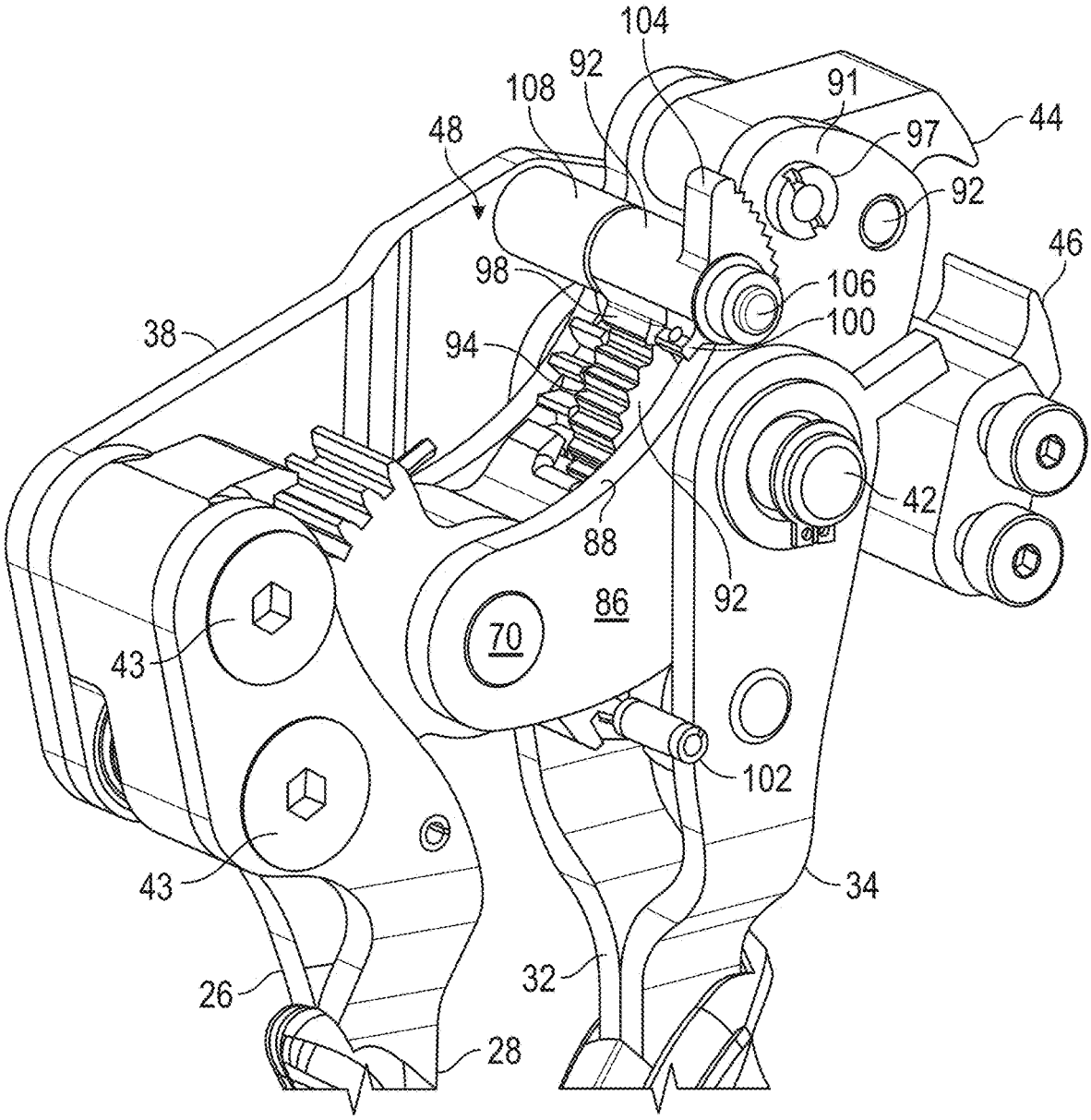
FIG. 5 is a partial enlarged perspective view of the crimping tool of FIG. 1A with a side plate removed.
Figure 6:
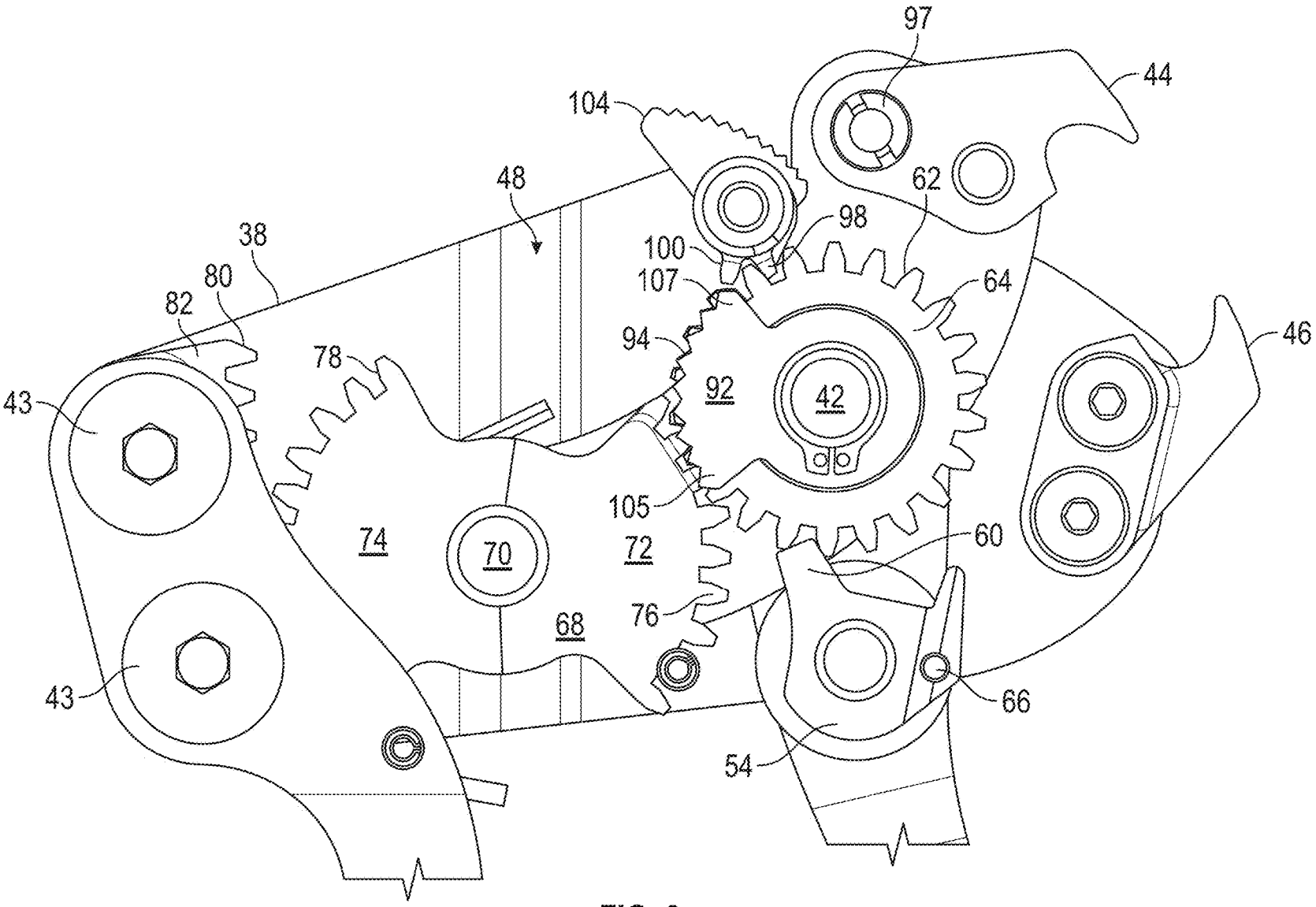
FIG. 6 is a partial side view of the crimping tool of FIG. 5.
Figure 7:
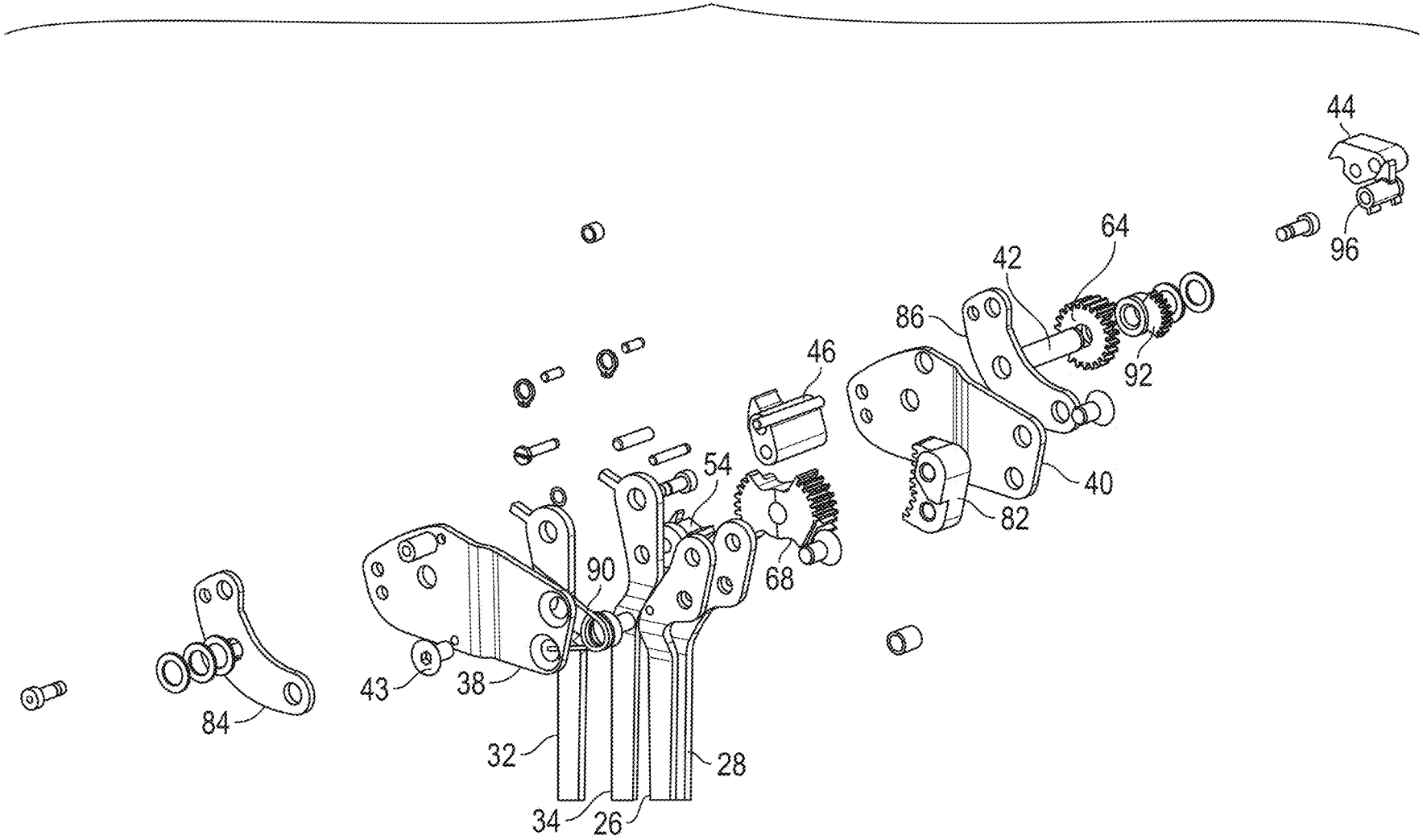
FIG. 7 is a partial disassembled view of the crimping tool of FIG. 1A.

Referring now to FIG. 5 and FIG. 6, with continuing reference to FIGS. 1-4, a ratchet portion is shown of the crimping mechanism 48. It should be appreciated that while the drive gear 64, transfer member 68 and linkages 84, 86 move the movable jaw 44 to a closed position (i.e. to crimp the band clamp), once the movable handle 24 is released by the operator, the movable jaw 44 will move away from the stationary jaw 46. In some embodiment, it is desirable to allow the operator to release the movable handle 24 and maintain the movable jaw 44 in position.

In an embodiment, a ratchet gear 92 is pivotally coupled to the main axle 42. The ratchet gear 92 is further coupled to (e.g. rotates with) the drive gear 64. The ratchet gear 92 includes a plurality of teeth 94. In an embodiment, the teeth 94 have a straight or triangular profile and extend over an arc length of less than 180 degrees. It should be appreciated that as the drive gear 64 is rotated by the drive pawl 54, the ratchet gear is also rotated.

The drive mechanism 48 further includes a holding pawl 96. The holding pawl includes a generally cylindrical body with a lever 98 extending therefrom. The lever 98 is positioned and sized such that the end of the lever 98 will engage the teeth 94 of the ratchet gear 92. The holding pawl 96 also includes a feature, such as projection 100 for example, which couples a biasing member (not shown) to the holding pawl 96. The biasing member is arranged to rotate the lever 98 into engagement with the teeth 94. In the exemplary embodiment, the biasing member is an extension spring coupled between the projection 100 and a spring pin 102. It should be appreciated that when the lever 98 is engaged with the teeth 94, the ratchet gear 92 and the drive gear 64 are prevented from rotating in the clockwise direction (from the viewpoint of FIG. 6). This allows the movable handle 24 to be moved from the second position back to the first position without releasing the movable jaw 44 from the band clamp being crimped. This provides advantages in allowing the operator to actuate the handle multiple times to obtain the desired level of crimp.

In an embodiment, when the lever 98 reaches the last tooth 105 (FIG. 6) of the teeth 94, the mechanism 48 will automatically reset under the biasing force of the springs within the mechanism 48 and the opening of the handles 22, 24. As the mechanism resets, the movable jaw 44 will move to the open position and the ratchet gear 92 will rotate to position the first tooth 107 of the teeth 94 adjacent the lever 98 as shown in FIG. 6.

In an embodiment, the ratchet gear 92 includes a handle portion 104. In an embodiment, the handle portion 104 extends through the cover and is accessible to the operator during operation. Once the desired level of crimp is achieved, the operator rotates ratchet gear 92 by applying a force to the handle portion 104. By rotating the ratchet gear 92 counter-clockwise (from the viewpoint of FIG. 6), the lever 98 is rotated away from the teeth 94 to release the ratchet gear 92. With the ratchet gear 92 released, the linkages 84, 86 are moved under the biasing force of spring 90 to rotate the movable jaw 44 (FIGS. 10-11B) away from the stationary jaw 46. With the jaws 44, 46 separated, the tool 20 may be separated from the crimped band clamp.

Figure 10:
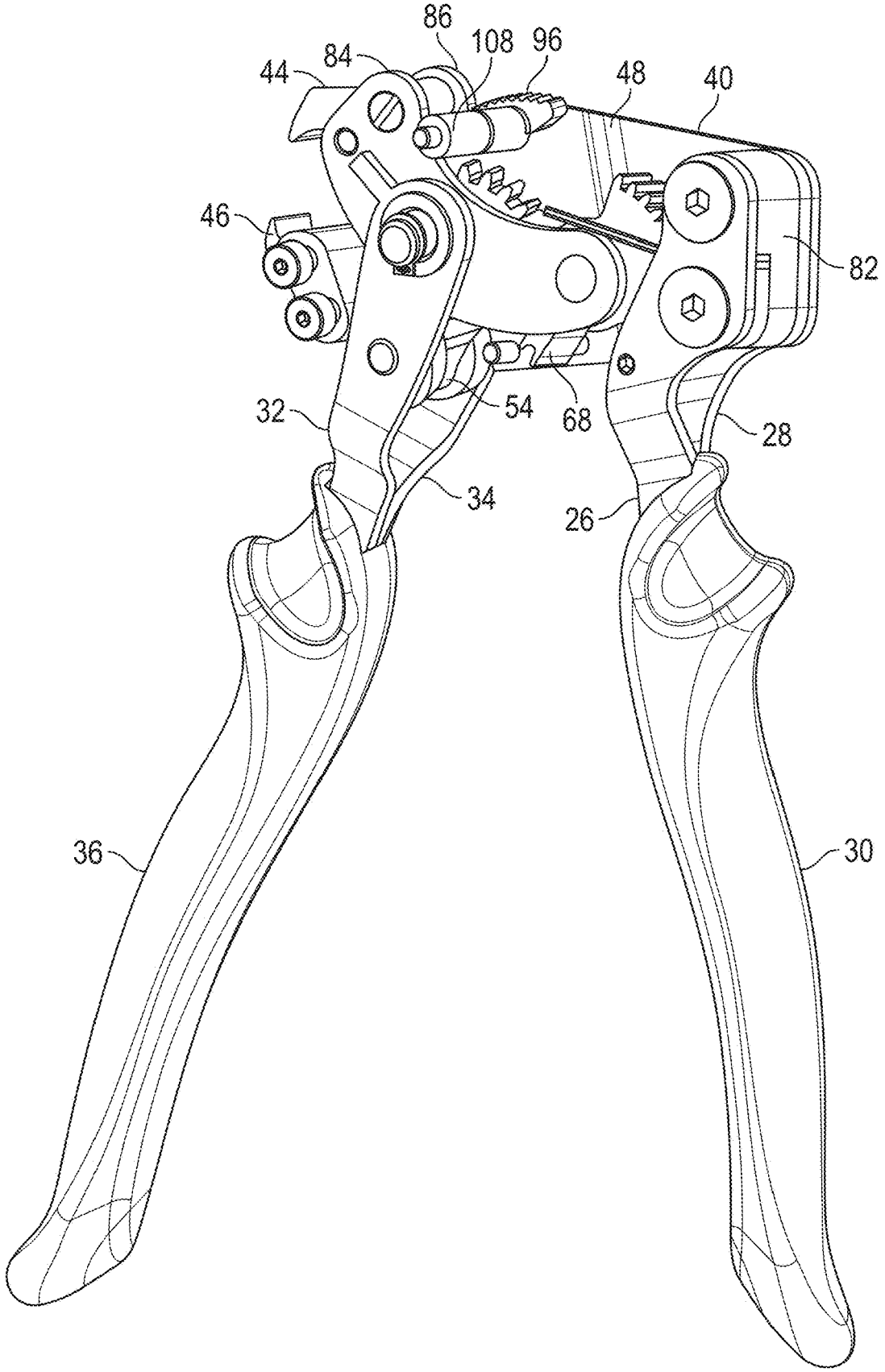
FIG. 10 is a perspective view of the crimping tool of FIG. 1A in a released position and with a side plate removed.
Figure 11A:
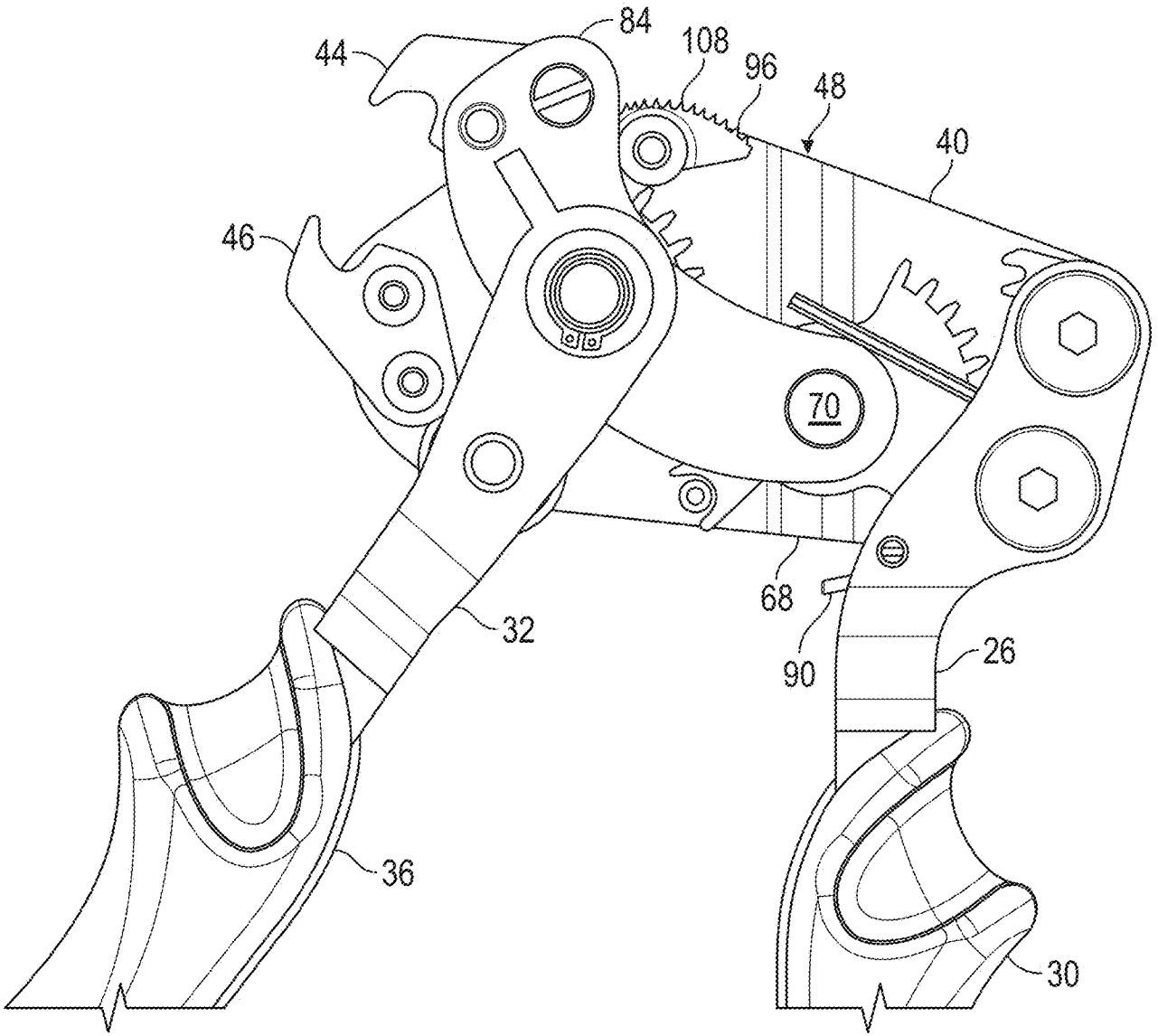
FIG. 11A and FIG. 11B are partial side views of the crimping tool of FIG. 10.

In the exemplary embodiment, the holding pawl 96 rotates about pin 106. In an embodiment, the cylindrical body portion of the holding pawl 96 engages the side 88 of the linkages 84, 86 as the moveable handle 24 moved to the released position (FIGS. 10-11). In an embodiment, a second spacer member 108 having a cylindrical body will be positioned on the pin 106.

Figure 11B:
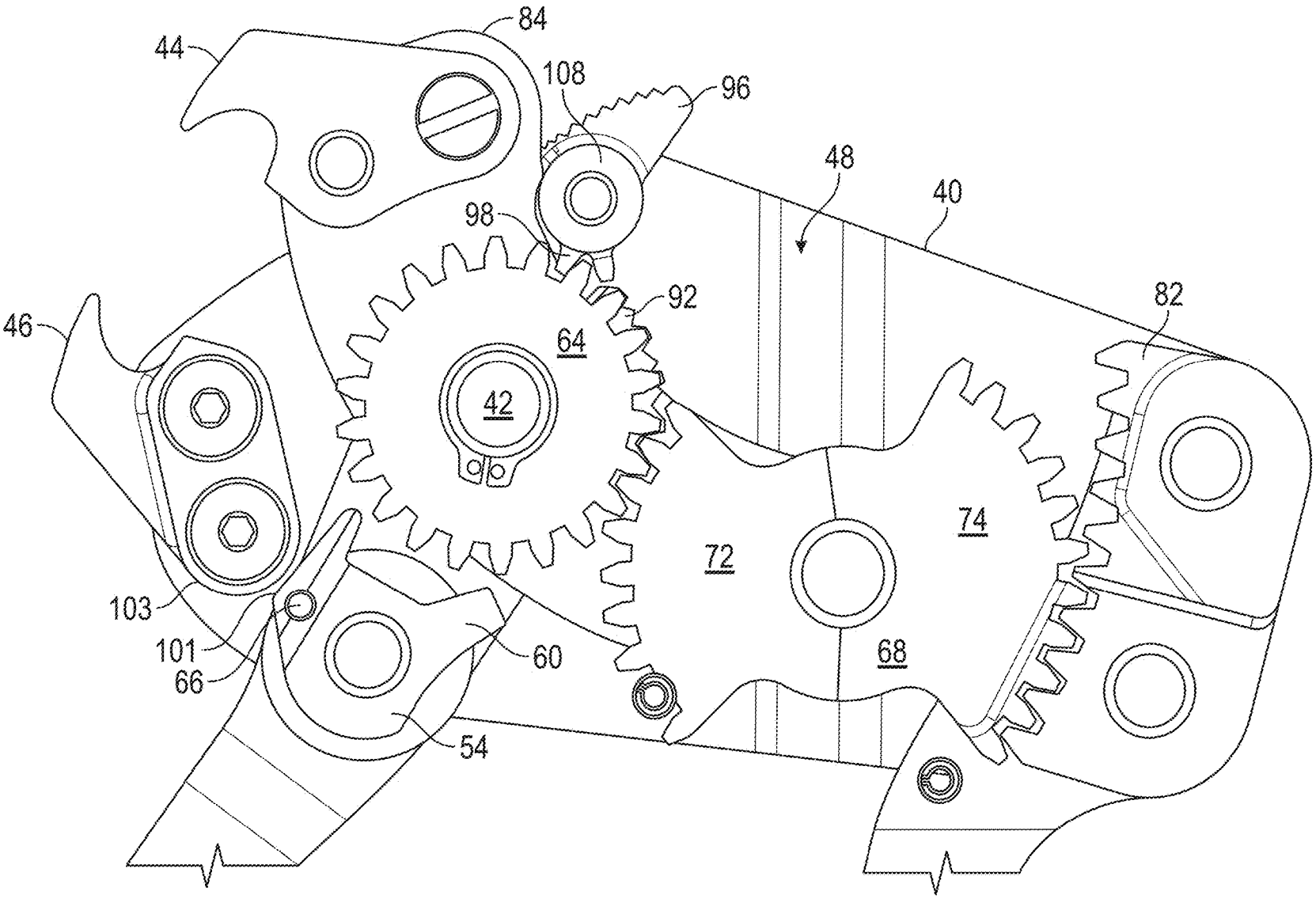

In an embodiment, shown in FIG. 11B, when the tool 20 is moved to a released position, the movable handle 24 is moved to a third position (FIG. 11B) wherein an arm portion 101 of the drive pawl 64 is moved into contact with a body portion 103 of the stationary jaw 46. It should be appreciated that the body portion 103 acts a stop for the movable handle 24.

Figure 12:
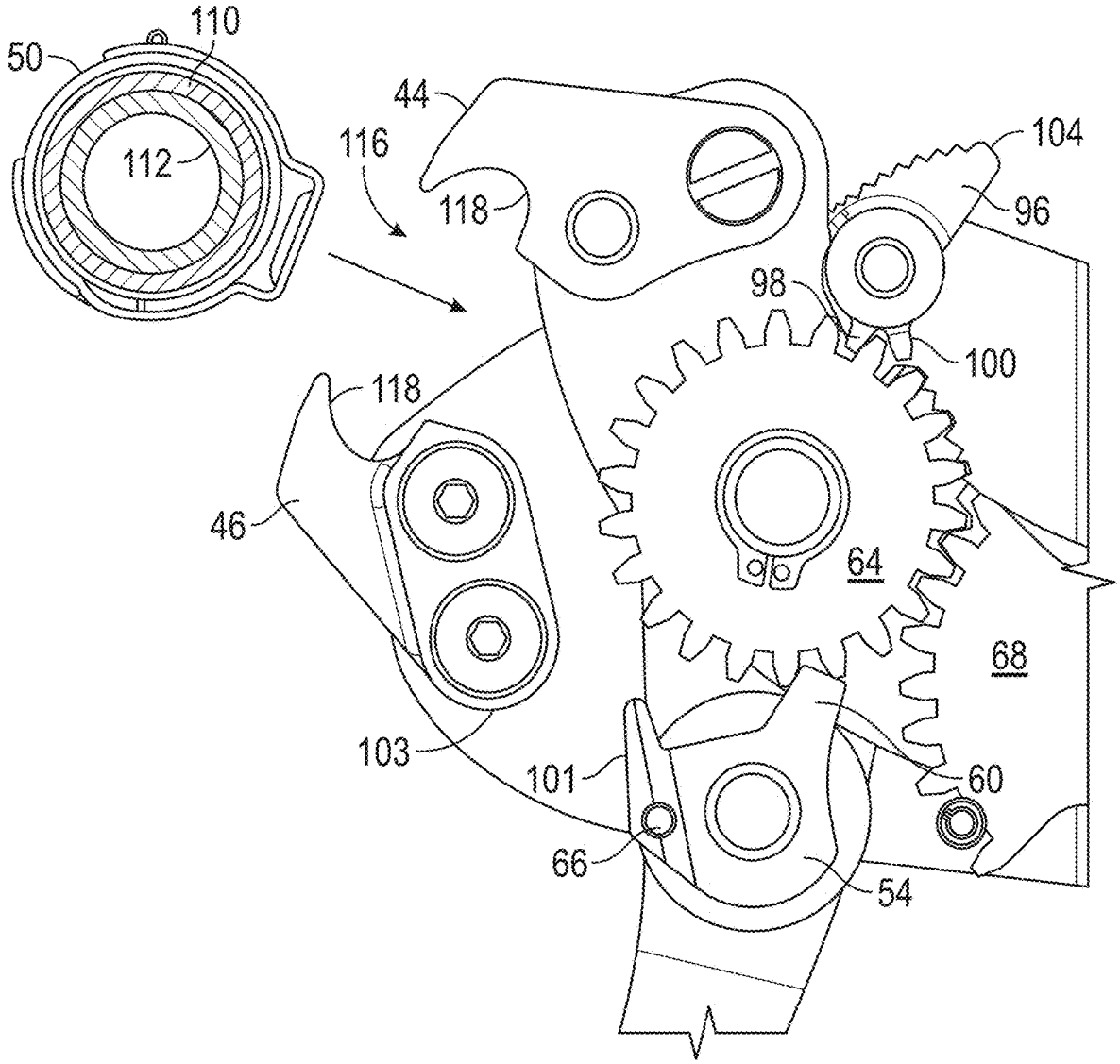
FIG. 12, FIG. 13 and FIG. 14 are side views of a process for crimping a band clamp using the crimping tool of FIG. 1A.
Figure 13:
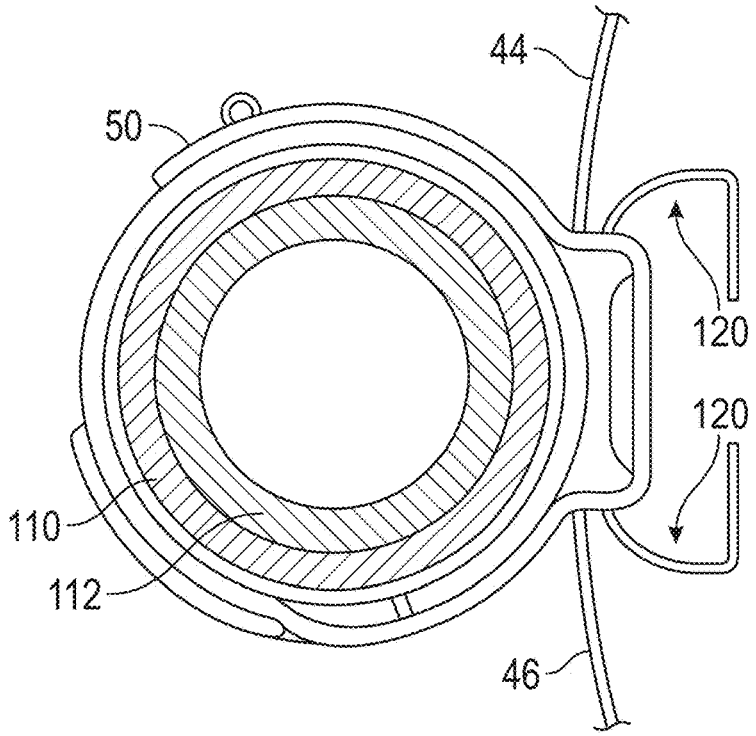
Figure 14:
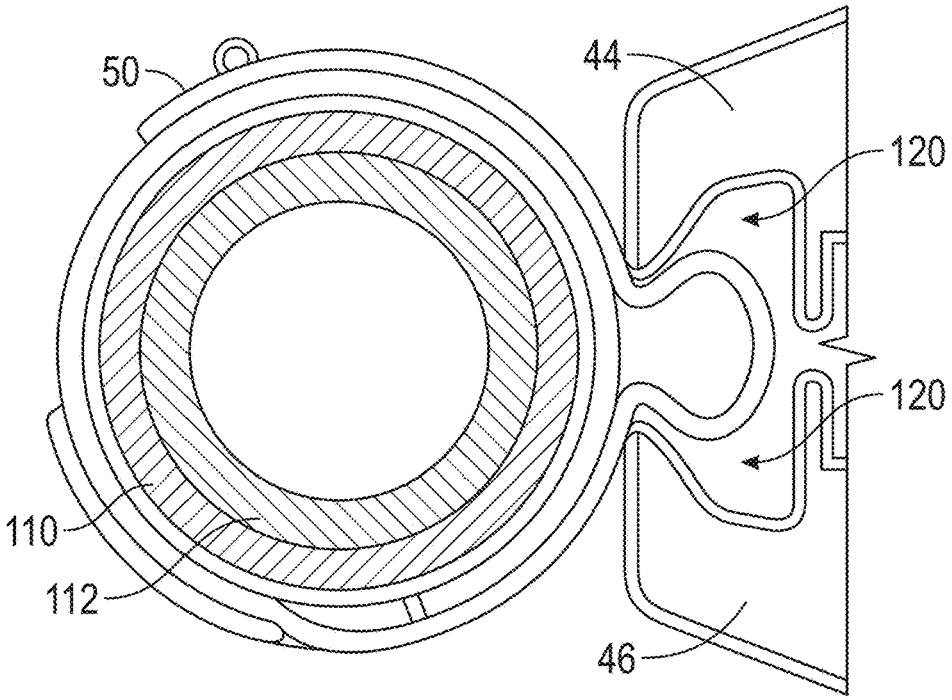

Referring now to FIGS. 12-14, the operation is shown of the tool 20 to crimp a band clamp 50. The operator initially slides the band clamp 50 onto the tube 110 to be coupled and installs the end of the tube 110 over a fitting 112. The band clamp 50 has a u-shaped section, sometimes referred to as an "ear" 114. The ear 114 is inserted into the gap 116 between the movable jaw 44 and the stationary jaw 46.

By actuating the movable handle 24, the crimping mechanism 48 engages the sides of the ear 114 causing the ear 114 to deform by bending inwardly (FIG. 13). As the ear 114 deforms, the band portion of the band clamp 50 is pulled towards the ear 114. This has the effect of reducing the diameter of the band clamp 50, tightening the band clamp 50 on the tube 110 and the fitting 112. As the operator continues to actuate the movable handle 24, the crimping mechanism 48 moves the movable jaw 44 towards the stationary jaw 46 until the desired amount of crimp is achieved (FIG. 14). In an embodiment, the jaws 44, 46 each have a curved surface 118 that defines an area 120 that allows the ear 114 to deform as the jaws 44, 46 are closed.

Referring now to FIGS. 15-20, another embodiment of a crimping tool 200 is shown, which has handles 202, 204 that are oriented in line with the jaws 206, 208. In other words, the handles 202, 204 are oriented about 90 degrees relative to the handles 22, 24 of tool 20 shown in FIG. 1A. In this embodiment, the tool 20 includes a stationary handle 202 and a movable handle 204. The stationary handle 204 is formed by, or is integral with, a pair of side plates 210, 212. A cover 214 surrounds and encloses a portion of the side plates 210, 212. In an embodiment, the cover 214 may be formed from multiple components. The movable handle 204 includes a first member 216 that is coupled to a pair of plates 218, 220. The plates 218, 220 are pivotally coupled to the side plates 210, 212 by an axle or pin 222. A first cover 224 extends over the first member 216, a second cover 226 is arranged between the plates 218, 220 to at least partially enclose the bottom of the moveable handle 204.

As will be discussed in more detail, a drive pawl 228 is pivotally coupled between the plates 218, 220 adjacent the stationary jaw 208 by a pin 230. The drive pawl 228 includes a first lever portion 232 and a second lever portion 234. The drive pawl is biased, such as with a spring (not shown) for example, into engagement with a drive gear as will be described in more detail. The engagement of the drive pawl 228 with the drive gear causes the rotation of the drive gear and the movement of the movable jaw 206. In an embodiment, the drive pawl is biased by an extension spring coupled between a hole 229 (FIG. 20) on the drive pawl 228 and a spring pin positioned between the side plates adjacent the handle.

The stationary jaw 208 is coupled to the side plates 210, 212 by pins 223. In an embodiment, the stationary jaw includes a jaw portion 239 similar to that described herein with respect to stationary jaw 46. The movable jaw 206 is coupled to rotate relative to the side plates 210, 212 by axle or pin 222. Movable jaw 206 further includes a body 240 with a u-shaped channel 242 (FIG. 16B) extending therethrough. It should be appreciated that the movable jaw 206 rotates relative to the side plates 210, 212 due to the engagement of the drive pawl 228. At least partially disposed within the channel 242 is a drive gear 244 and a transfer member 246. In this embodiment, the drive gear 244 is formed from a single member that is coupled to rotate about the pin 222. The drive gear 244 includes a first plurality of teeth 250 and a second plurality of teeth 252. In the illustrated embodiment, the first plurality of teeth 250 has an outside/addendum circle that is radially smaller than the outside/addendum circle of the second plurality of teeth 252. The first plurality of teeth 250 engage with an end of the second lever portion 234 to rotate the movable jaw 208 about the pin 222 when the movable handle 204 is moved (e.g. squeezed) relative to the stationary handle 202. In an embodiment, the second lever portion 234 is sized to move between a pair of adjoining teeth 250 with the end of the second lever portion 234 contacting a first tooth and a back side of the second lever portion 234 contacting the adjoining tooth. This arrangement locks the second lever portion 234 against the teeth 250 while the movable handle 204 is moved. When the moveable handle 204 is released, the movable handle 204 is biased away from the stationary handle 202. As the movable handle 204 moves from the second position (FIG. 17) to the first position (FIG. 16A), the drive pawl 228 rotates about pin 230 to release the second lever portion 234 from the teeth 250. It should be appreciated that one the movable handle 204 stops moving, the biasing force of the spring attached to the drive pawl 228 cause the second lever portion 234 to reengage the teeth 250.

Coupled to the drive gear 244 is a transfer member 248. In an embodiment, the transfer member 248 is a sun gear with three gear portions 254, 256, 258. The transfer member 248 is pivotally mounted on pin 236. The first gear portion 254 includes a plurality of gear teeth that are sized and positioned to engage the teeth 252 of the drive gear 244. In an embodiment, the gear teeth of first gear portion 254 have an involute profile shaped to engage the teeth 252 of the drive gear 244. In an embodiment, the plurality of gear teeth 254 extend over an arc length of less than 90 degrees, and in an embodiment less than 60 degrees. The second gear portion 256 also includes a plurality of gear teeth that are arranges to engage the teeth 250 of drive gear 244. In an embodiment the gear teeth of second gear portion 256 extend over an arc length of less than 90 degrees, and in another embodiment less than 60 degrees, and have an involute profile. In the illustrated embodiment, the first gear portion 254 has a an outside/addendum circle that is radially smaller than the outside/addendum circle of the second gear portion 256. The third gear portion 258 has gear teeth arranged to engage gear teeth 260 of ring gear 262. The ring gear 262 is coupled to, and stationary relative to, the side plates 218, 220. In an embodiment, the ring gear 262 is coupled to the side plates 218, 220 by the fasteners 264.

Figure 15:
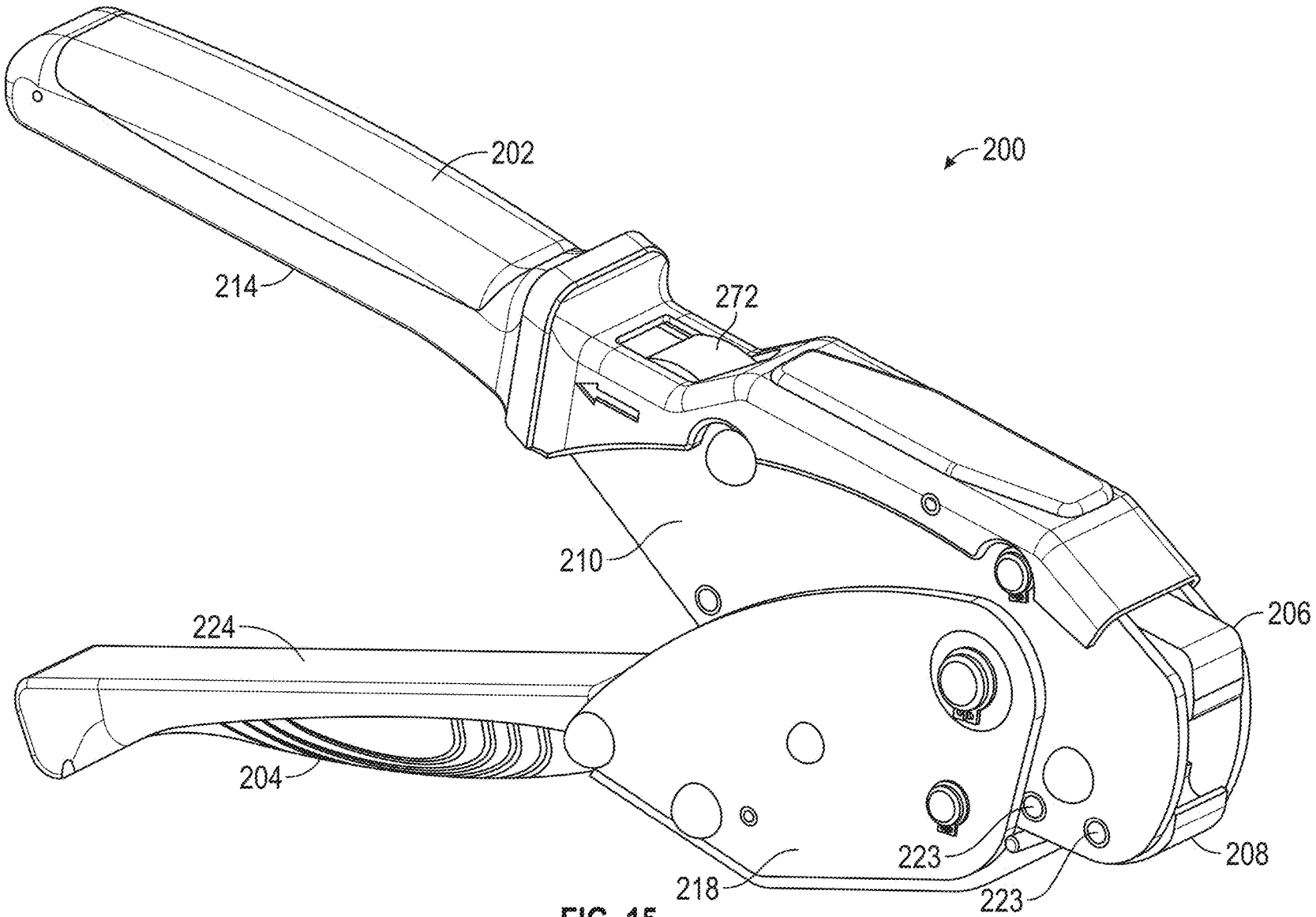
FIG. 15 is a perspective view of a crimping tool in accordance with another embodiment.
Figure 16A:
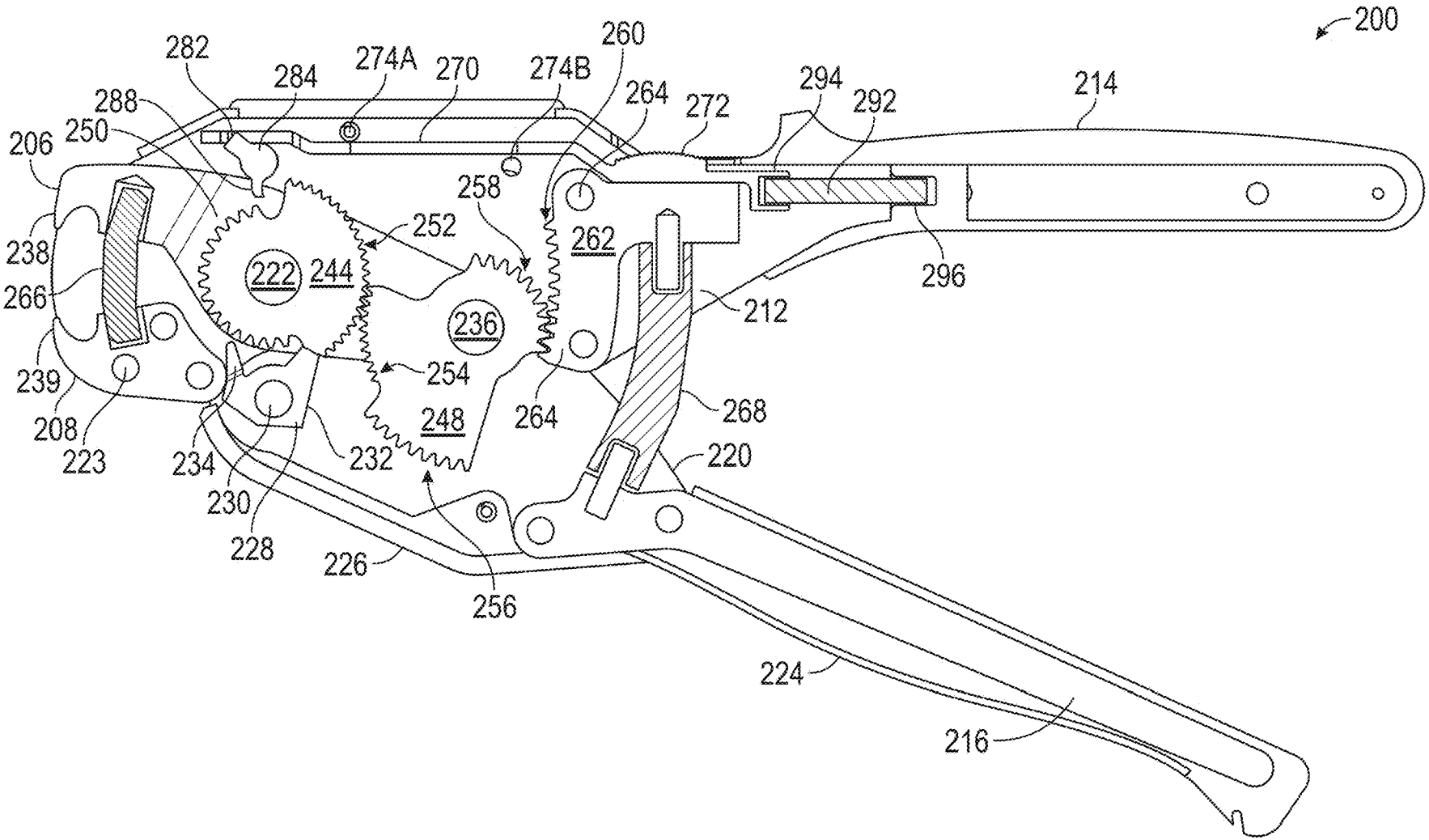
FIG. 16A is a side sectional view of the crimping tool of FIG. 15.
Figure 16B:
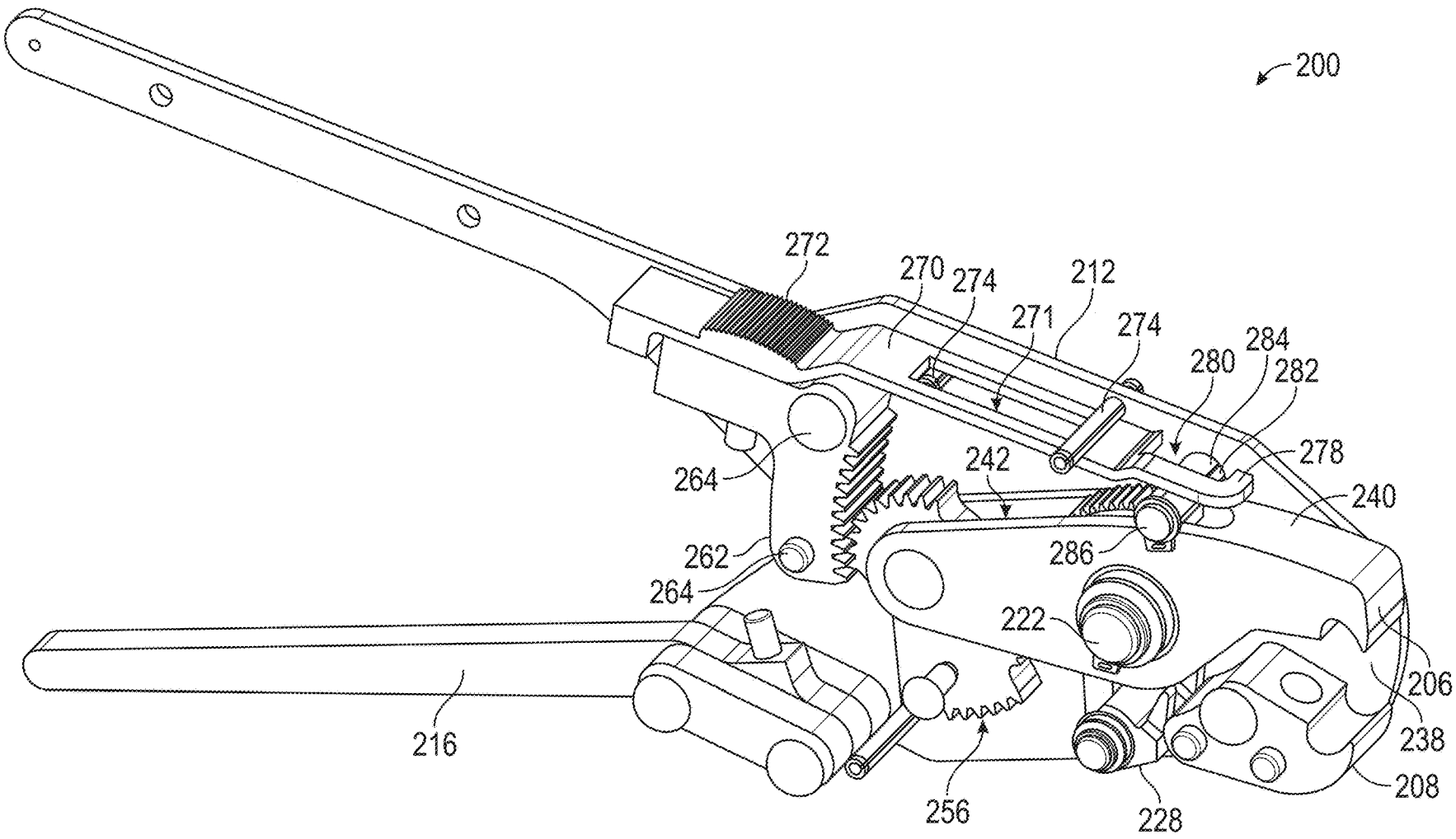
FIG. 16B is a perspective view of the crimping tool of FIG. 15 with a side plate and cover removed.
Figure 17:
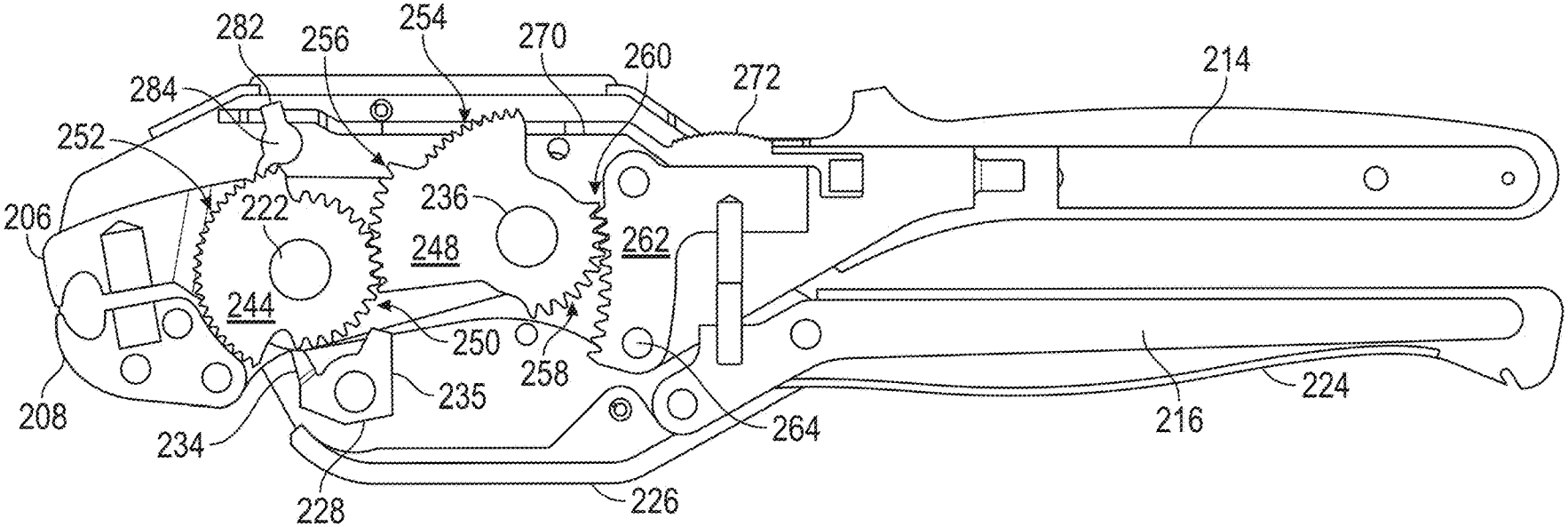
FIG. 17 is a side sectional view of the crimping tool of FIG. 15 with the handle in the closed position and the jaws in the closed position.
Figure 18:
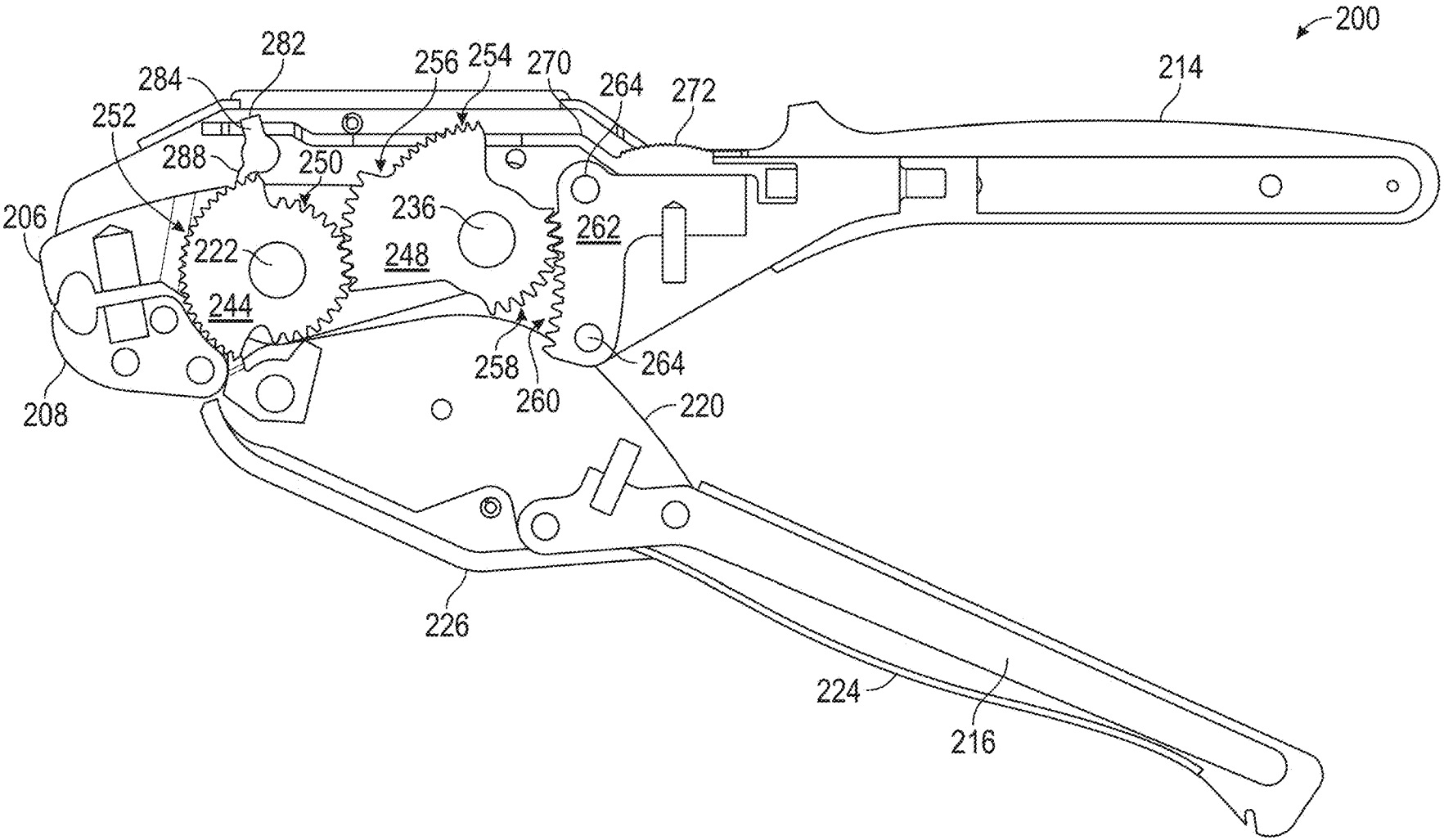
FIG. 18 is a side sectional view of the crimping tool of FIG. 15 with the handle in the open position and the jaws in the closed position.
Figure 19:
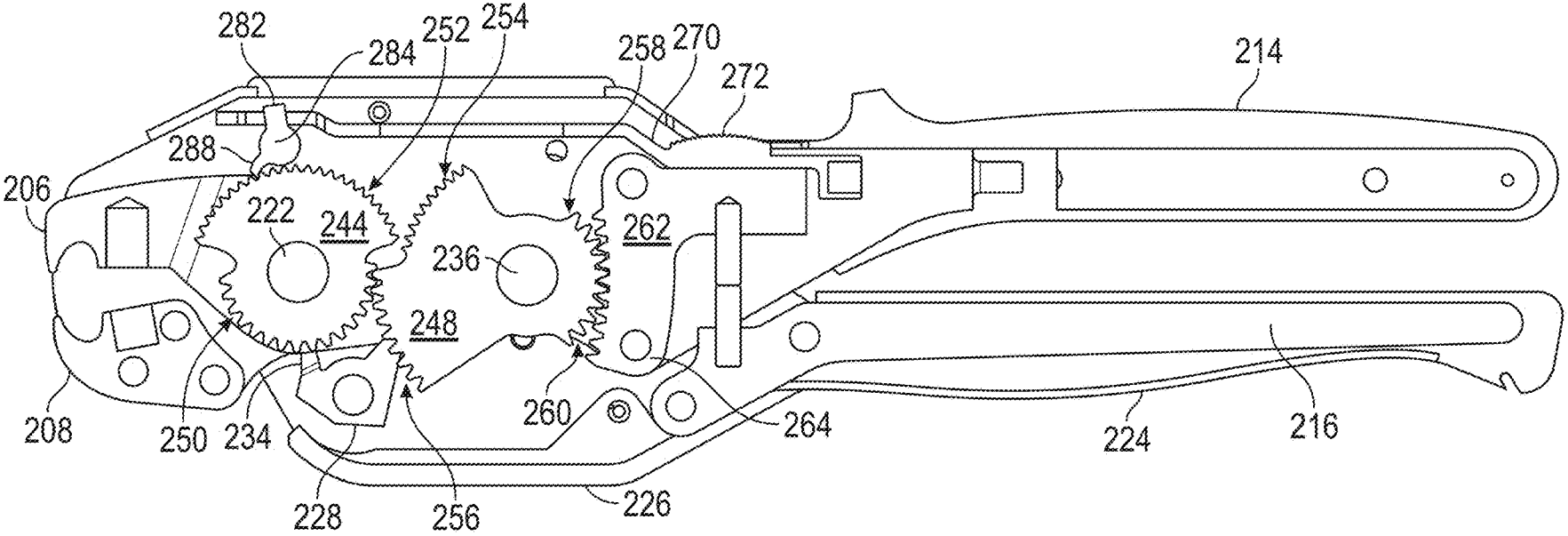
FIG. 19 is a side sectional view of the crimping tool in a released position.
Figure 20:
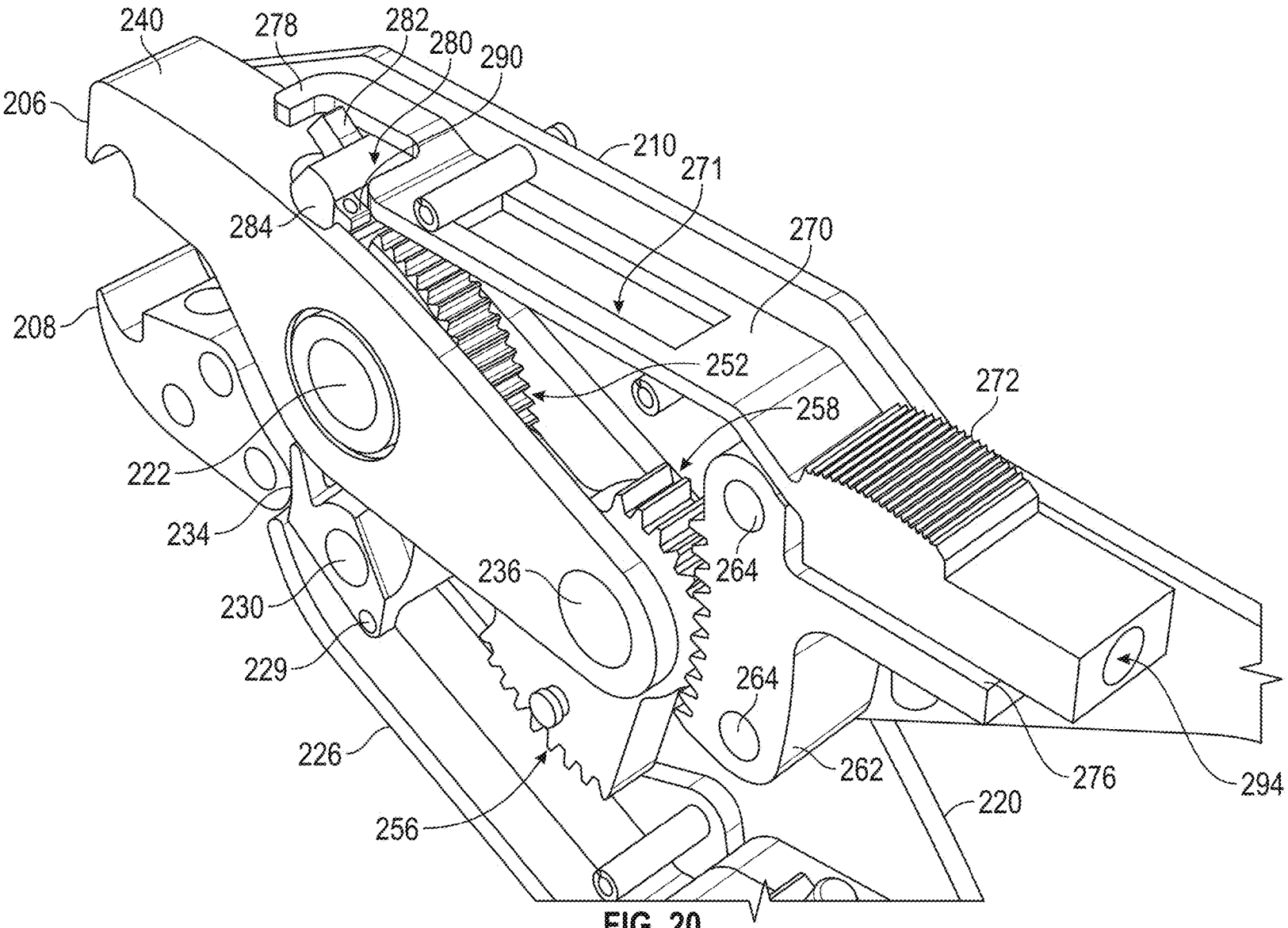
FIG. 20 is a partial perspective view with a side plate removed.

The tool 200 is generally biased to the open position (e.g. jaws in the open position of FIG. 15). In an embodiment a first biasing member 266 is disposed between the stationary jaw 206 and the movable jaw 208. In an embodiment the first biasing member 266 is a compression spring disposed within pockets formed in the jaws 206, 208. The tool may further include a second biasing member 268 disposed between the handles 202, 204. In an embodiment, the second biasing member 268 is a compression spring that acts to rotate the handles 202, 204 in a direction to open the jaws 206, 208.

The tool 200 further includes a release lever 270. The lever 270 includes an elongated body having an actuator button 272 projecting from one side. In an embodiment, the button 272 extends through the cover 214 and is generally positioned so that the operator can actuate or move the button 272 with their thumb when the operator's hands are holding the tool. The lever 272 is laterally slidable between the side plates 210, 212. The lever 270 is captured between a pair of pins 274A, 274B and the area adjacent the button 272 is supported by a surface 276 (FIG. 20) of the ring gear 262. As will be discussed in more detail, a J-shaped end portion 278 defines an open sided slot 280.

Disposed within the slot 280 is a projection 282 that extends from a holding pawl 284. The holding pawl 284 is coupled to the side plates 210, 212 to rotate about a pin 286. The holding pawl 284 includes an arm 288 that engages the plurality of teeth 250 of drive gear 244. In an embodiment, the holding pawl 284 is biased to engage the arm 288 with the teeth 250 by an extension spring (not shown) that extends from a hole 290 (FIG. 20) to spring pin 274B. A compression spring 282 biases the release lever 270 towards the jaw end of the tool 200. As the operator repeated closes (handle position of FIG. 17) and opens (handle position of FIG. 16A) the handles 202, 204, the arm 288 of holding pawl 284 keeps the drive gear 244 from rotating back (e.g. the clockwise direction when viewed from the viewpoint of FIG. 16A). Thus the repeated actuation of the handles 202, 204 causes the jaws 206, 208 to close allowing the crimping of the band clamp.

It should be appreciated that when the operator slides the button 270 away from the jaw end, the end of the slot 280 engages the projection 282 causing the holding pawl 284 to rotate so that the arm 288 disengages from the teeth 250. The disengagement of the holding pawl 284 in turn allows the drive gear 244 to rotate and the jaws 206, 208 to move to an open position (FIG. 19, FIG. 20) under the biasing force of springs 266, 268. When the operator releases the button, a compression spring 292 bias's the release lever in a direction towards the jaw end of the tool 200 allowing the holding pawl 284 to rotate back into engagement with the drive gear 244. In an embodiment, the compression spring 292 is positioned between a pocket 294 in the end of the release lever 270 and a pocket 296 in the cover 214.

In an embodiment, the release lever 270 includes a slot 271 arranged between the slot 280 and the button 272. The slot 271 is sided and positioned to allow clearance for a portion of the transfer member 248 to pass therethrough (FIG. 17, FIG. 18) during operation of the tool 200.

The operation of the tool 200 is similar to that of tool 20. The operator inserts the ear of the band clamp between the jaw portions 238, 239 when the jaws 206, 208 are open. As the operator actuates the movable handle 204 between the first position (FIG. 16A) and the second position (FIG. 17), the second lever portion 234 engages the teeth 250 causing the rotation of the drive gear 244 (in the counter clockwise direction when viewed from the viewpoint of FIG. 16A). This rotation causes the teeth 252 to engage the first gear portion 254 and rotate the transfer member 248 (in the clockwise direction when viewed from the viewpoint of FIG. 4). Since the third gear portion 258 is engaged with the teeth 260 of ring gear 262, the transfer member 248 will both rotate about the pin 236 and simultaneously rotate about the pin 222. The rotational movement of the transfer member 248 about the pin 222 causes the movable jaw 206 to move towards the stationary jaw 208.

As described above, when in the handle 204 is moved from second position (FIG. 17) back to the first position (FIG. 18), the holding pawl 284 prevents clockwise rotation (when viewed from the viewpoint of FIG. 17) of the drive gear 244. It should be appreciated that as the drive gear 244 and transfer member 248 are rotated, the engagement of the teeth 252 and first gear portion 254 will end and the teeth 250 and second gear portion 256 will engage. In an embodiment, the gear ratio between the teeth 250 and second gear portion 256 provides a mechanical advantage that assists the operator in crimping the band clamp.

Thus, by repeatedly moving the handles 202, 204 between the first and second positions, the jaws 206, 208 are brought closer to each other and the ear portion of the band clamp is crimped as described in reference to FIGS. 12-14. Once the desired crimp has been formed, the operator may release the mechanism by sliding the release lever 270 away from the jaw end. As described above, this disengages the holding pawl from the teeth 250 and drive gear 244 may rotate (in the clockwise direction from the viewpoint of FIG. 16A) allowing the jaws 206, 208 to open under the biasing force of the springs 266, 268 or forces generated by the elasticity of the material in the crimped band clamp. The rotation of the drive gear 244 stops when the end of the first arm portion 232 of drive pawl 228 contacts the transition surface between the first plurality of teeth 250 and the second plurality of teeth 252 of drive gear 244.

It should be appreciated that while embodiments herein refer to the use of a tool 20 with a particular type of clamp (e.g. a ear type band clamp), this is for exemplary purposes and the claims should not be so limited. In other embodiments, the tool 20 may be used with other types of clamps. In still other embodiments, the tool 20 may be adapted to perform a cutting operation or be used in cooperation with ring clamps.

Technical effects and benefits of some embodiments include providing a tool that allows the crimping of a clamp through a ratchet mechanism where the tool may be repetitively actuated to form the desired crimp. Further technical benefits include a crimping mechanism that provides a mechanical advantage in the crimping force that allows the tool to have smaller handles.

The term "about" is intended to include the degree of error associated with measurement of the particular quantity based upon the equipment available at the time of filing the application. The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A crimping tool comprising: a stationary jaw; a movable jaw adjacent the stationary jaw, the movable jaw being rotatable about an axle from an open position to a crimped position; a transfer member having a first gear portion, a second gear portion and a third gear portion, the transfer member being pivotally coupled to the movable jaw, the transfer member rotating relative to the movable jaw and relative to the axle as the movable jaw moves from the open position to the crimped position; a ring gear operably coupled to the third gear portion, the ring gear cooperating with the third gear portion to rotate the transfer member about the axle; a drive gear rotatably coupled to the axle and operably coupled to the first gear portion and the second gear portion, the drive gear and first gear portion, the second gear portion and the third gear portion cooperating to rotate the transfer member relative to the movable jaw and the axle; a movable handle pivotally coupled to the axle; and a drive pawl pivotally coupled to the movable handle and operably coupled to the drive gear, the handle and drive pawl cooperating to rotate the drive gear in response to the movable handle moving from a first position to a second position.

2. The crimping tool of claim 1, further comprising a holding pawl rotatable between a first holding pawl position and a second holding pawl position, the holding pawl being positioned to engage the drive gear in the first holding pawl position and disengaged from the drive gear in the second holding pawl position.

3. The crimping tool of claim 2, wherein the holding pawl includes a projection and an arm, the arm being disposed to engage the drive gear in the first holding pawl position.

4. The crimping tool of claim 3, further comprising a release lever having a body with a button at one end and a slot at a second end, the projection being disposed in the slot, wherein the slot engages the projection and rotates the holding pawl from the first holding pawl position to the second holding pawl position in response to lateral movement of the release lever.

5. The crimping tool of claim 4, further comprising at least one biasing member arranged to bias the movable jaw to the open position, wherein the drive gear rotates to move the movable jaw to the open position under the influence of the biasing member in response to the holding pawl being rotated to the second holding pawl position.

* * * * *